US006897838B2

(12) United States Patent
Okamoto

(10) Patent No.: US 6,897,838 B2
(45) Date of Patent: May 24, 2005

(54) MEMORY-INTEGRATED DISPLAY ELEMENT

(75) Inventor: Shigetsugu Okamoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 260 days.

(21) Appl. No.: 10/044,295

(22) Filed: Jan. 11, 2002

(65) Prior Publication Data

US 2002/0140642 A1 Oct. 3, 2002

(30) Foreign Application Priority Data

Jan. 18, 2001 (JP) ..... 2001-010868
Dec. 7, 2001 (JP) ..... 2001-374905

(51) Int. Cl.[7] ..... G09G 3/30
(52) U.S. Cl. ..... 345/76; 345/81
(58) Field of Search ..... 345/76, 78, 80, 345/81, 84, 85, 204, 205, 207, 691, 692, 694, 547, 555, 556, 557; 313/1, 2.1, 3, 5, 6; 315/169.3; 340/825

(56) References Cited

U.S. PATENT DOCUMENTS 4,996,523 A * 2/1991 Bell et al. ..... 345/77
5,945,972 A * 8/1999 Okumura et al. ..... 345/98
6,229,506 B1 * 5/2001 Dawson et al. ..... 345/82
2001/0043173 A1 * 11/2001 Troutman ..... 345/82
2002/0044110 A1 * 4/2002 Prache ..... 345/82

FOREIGN PATENT DOCUMENTS

| | | | |
|---|---|---|---|
| JP | 08-194205 | 7/1996 | ..... G02F/1/133 |
| JP | 08-286170 | 11/1996 | ..... G02F/1/133 |
| JP | 2775040 | 5/1998 | ..... G02F/1/133 |
| JP | 10-161564 | 6/1998 | ..... G09F/9/30 |
| JP | 11-119698 | 4/1999 | ..... G09F/9/33 |
| JP | 2000-206920 | 7/2000 | ..... G09F/3/20 |

* cited by examiner

*Primary Examiner*—Amare Mengistu
*Assistant Examiner*—Nitin Patel
(74) *Attorney, Agent, or Firm*—Edwards & Angell, LLP; David G. Conlin; George W. Hartnell, III

(57) ABSTRACT

In each pixel of a display element, a memory circuit is made up of two complementary inverters which are connected to each other in a loop manner, and stores whether or not to light an Organic Emission Diode, according to a potential which is given via a select circuit in a select period. An output end of one of the inverters is directly connected to an anode of the Organic Light Emission Diode, and both TFTs of the inverter drive the Organic Light Emission Diode. Thus, even though dispersion in manufacturing occurs, it is possible to light/unlight the Organic Light Emission Diode at the same luminance level. As a result, even though dispersion occurs in characteristics of elements which make up a pixel, it is possible to realize a memory-integrated display element which can light the optical modulation element at the same luminance level.

38 Claims, 16 Drawing Sheets

FIG. 6

VALUE OF PARAMETER $\alpha$ CONCERNING A POWER CONSUMPTION WITH RESPECT TO A COMBINATION OF ON RESISTANCE (RELATIVE VALUE) A AND OFF RESISTANCE (RELATIVE VALUE) B

| | B | | | | | | | | | | | | | |
|---|---|---|---|---|---|---|---|---|---|---|---|---|---|---|
| A | 20.000 | 10.000 | 5.000 | 2.000 | 1.000 | 500 | 200 | 100 | 50.0 | 20.0 | 10.0 | 5.00 | 2.00 | 1.00 |
| 0.01 | 1.010 | 1.010 | 1.010 | 1.011 | 1.011 | 1.012 | 1.015 | 1.020 | 1.030 | 1.061 | 1.112 | 1.214 | 1.523 | 2.040 |
| 0.02 | 1.020 | 1.020 | 1.020 | 1.021 | 1.021 | 1.022 | 1.025 | 1.030 | 1.041 | 1.072 | 1.124 | 1.229 | 1.545 | 2.080 |
| 0.05 | 1.050 | 1.050 | 1.050 | 1.051 | 1.051 | 1.052 | 1.056 | 1.061 | 1.072 | 1.105 | 1.161 | 1.272 | 1.613 | 2.200 |
| 0.10 | 1.100 | 1.100 | 1.100 | 1.101 | 1.101 | 1.102 | 1.106 | 1.112 | 1.124 | 1.160 | 1.221 | 1.344 | 1.725 | 2.400 |
| 0.20 | 1.200 | 1.200 | 1.200 | 1.201 | 1.201 | 1.203 | 1.207 | 1.214 | 1.228 | 1.271 | 1.342 | 1.488 | 1.950 | 2.800 |
| 0.50 | 1.500 | 1.500 | 1.500 | 1.501 | 1.502 | 1.504 | 1.510 | 1.520 | 1.540 | 1.601 | 1.705 | 1.920 | 2.625 | 4.000 |
| 1.00 | 2.000 | 2.000 | 2.001 | 2.002 | 2.003 | 2.006 | 2.015 | 2.030 | 2.060 | 2.153 | 2.310 | 2.640 | 3.750 | 6.000 |
| 2.00 | 3.000 | 3.001 | 3.001 | 3.003 | 3.005 | 3.010 | 3.025 | 3.050 | 3.101 | 3.255 | 3.520 | 4.080 | 6.000 | 10.00 |
| 5.00 | 6.001 | 6.001 | 6.002 | 6.006 | 6.011 | 6.022 | 6.055 | 6.111 | 6.222 | 6.563 | 7.150 | 8.400 | 12.75 | 22.00 |
| 10.0 | 11.00 | 11.00 | 11.00 | 11.01 | 11.02 | 11.04 | 11.11 | 11.21 | 11.42 | 12.08 | 13.20 | 15.60 | 24.00 | 42.00 |
| 20.0 | 21.00 | 21.00 | 21.01 | 21.02 | 21.04 | 21.08 | 21.21 | 21.41 | 21.83 | 23.10 | 25.30 | 30.00 | 46.50 | 82.00 |
| 50.0 | 51.01 | 51.01 | 51.02 | 51.05 | 51.10 | 51.20 | 51.51 | 52.02 | 53.04 | 56.18 | 61.60 | 73.20 | 114.0 | 202.0 |
| 100 | 101.0 | 101.0 | 101.0 | 101.1 | 101.2 | 101.4 | 102.0 | 103.0 | 105.1 | 111.3 | 122.1 | 145.2 | 226.5 | 402.0 |
| 200 | 201.0 | 201.0 | 201.1 | 201.2 | 201.4 | 201.8 | 203.0 | 205.0 | 209.1 | 221.6 | 243.1 | 289.2 | 451.5 | 802.0 |

MEMORY-INTEGRATED DISPLAY ELEMENT

FIELD OF THE INVENTION

The present invention relates to a memory-integrated display element in which a memory element is provided in each pixel.

BACKGROUND OF THE INVENTION

In a flat-type display device, there has been wide use of an active matrix type display device, in which a self luminous element such as an OLED (Organic Light Emission Diode), or a liquid crystal element is used as an optical modulation element, and a TFT (Thin Film Transistor) gate for addressing is provided on each pixel.

Here, in the active matrix type display device, a plurality of data lines and a plurality of select lines which cross respective data lines at right angles, are provided, and pixels are provided on respective crossing points of the data lines and the select lines. When a case of using the OLED as the optical modulation element is used as an example, as shown in FIG. 18, a select module 113 is conducted only in a select period in which a select line 103 is outputting a select signal SEL of a select level, and the select module 113 connects a data line 102 to a drive module 111 which drives the OLED 112.

While, in the drive module 111, a TFT 121 is provided between a power line Lr, to which a reference potential Vref is applied, and the OLED 112. A capacitor 122, which functions as a memory element, is connected to a gate of the TFT 121, and stores a data signal DATA in a select period, and the data signal DATA is applied to the gate of the TFT 121 also in a non-select period. Note that, like a pixel 104*a* shown in FIG. 19, the OLED 112 may be provided between the TFT 121 and the power line Lr.

However, in each of the pixels 104 (104*a*), since the data signal DATA is stored as the analog quantity, as shown in FIG. 20, a signal level of the data signal DATA, applied in the select period, declines gradually in the non-select period, due to a leak current in a circuit, and the like.

Thus, it is required that select periods are set cyclically, and a time changing rate of a potential, stored by the capacitor 122, is adjusted to such extent that the potential declining quantity in the cycle of the select period does not influence the display, for example, by setting a capacitance of the capacitor 122, and the like. Further, the capacitance, required by the capacitor 122, is determined in accordance with a display gradation number, but a capacitance, which can be formed in each (104*a*) of the pixels 104, is restricted, so that a gradation number, which can be displayed, or a cycle of the select periods is restricted.

Thus, Japanese Unexamined Patent Publication No. 161564/1998 (Tokukaihei 10-161564) (publication date: Jun. 19, 1998) proposes a display device, having a structure in which a voltage drive type EL element is used as an optical modulation element, wherein a gate insulating film of the TFT 121 is formed by using a nitriding silicon film in which an impurity ion is doped, so as to give an EEPROM function to the TFT 121 instead of providing the capacitor 122. Further, Patent Gazette No. 2775040 (registration date: May 1, 1998) discloses an optical modulation element, having a structure in which a voltage drive type liquid crystal is used, wherein a ferroelectric capacitor stores a data signal DATA. According to the structures, unlike the structures shown in FIG. 18 and FIG. 19, a decline of a potential level is restricted, so that it is possible to store the data signal DATA for a long time.

Further, as another structure which is different from the structure in which the data signal DATA is stored as the foregoing analog quantity, for example, Japanese Unexamined Patent Publication No. 194205/1996 (Tokukaihei 8-194205) (publication date: Jul. 30, 1996) and Japanese Unexamined Patent Publication No. 119698/1999 (Tokukaihei 11-119698)(publication date: Apr. 30, 1999) propose a structure in which, like the pixel 104*b* shown in FIG. 21, a memory element 123, provided instead of the capacitor 122, stores a binary of light/light-off of an optical modulation element, and a gradation display is performed in accordance with an area modulation. According to the structure, since the binary is stored, it is possible to store the data signal DATA for a long time, compared with a case of storing as the analog quantity.

SUMMARY OF THE INVENTION

The object of the present invention is to realize a memory-integrated display element which can light an optical modulation element at a constant luminance level even though dispersion occurs in elements which make up a pixel.

In order to achieve the foregoing object, a memory-integrated display element of the present invention, which includes: an optical modulation element provided in a pixel; and a memory element, provided in the pixel, which stores binary data which indicates a value inputted to the optical modulation element, wherein the memory element is arranged by connecting at least two inverters in a loop manner, and an output of an output inverter, one of the inverters (11*a* or 11*b*), which functions as an output end of the memory element, is directly connected to one end of the optical modulation element.

According to the foregoing structure, since the output inverter of the memory element drives the optical modulation element, compared with a prior art in which the memory element is connected to the optical modulation element via a drive switching element, it is possible to reduce the number of switching elements due to elimination of the drive switching element, without bringing about any trouble in driving the optical modulation element.

Further, since the drive switching element does not exist between the memory element and the optical modulation element, it is possible to obtain the following advantage. Even though the dispersion brought about in manufacturing occurs, variation of the luminance level of the optical modulation element, which is brought about by variation of a characteristic of the drive switching element, does not occur. Thus, the optical modulation element can be lighted at a constant luminance level.

Note that, according to a structure of the prior art, in a case where dispersion occurs in a threshold value characteristic of the drive switching element (TFT 121), which drives the optical modulation element, due to the dispersion brought about in manufacturing at a time when many pixels are formed, there occurs such a problem that luminance, which should be uniform, becomes hetereogeneous to a large extent.

Particularly, since an LED (Light Emission Diode), which functions as a current drive type optical modulation element, has a luminous characteristic based on an exponential function of an applied voltage, a current applied into the LED varies greatly when the dispersion occurs in the threshold value characteristic. Thus, compared with a voltage drive type liquid crystal element etc., the dispersion occurs in the luminance to a large extent.

On the other hand, in the present invention, since an output of the output inverter, which functions as an output end of the memory element, is directly connected to one end of the optical modulation element, variation of the luminance level of the optical modulation element, which is brought about by variation of a characteristic of the drive switching element, does not occur, even though the dispersion occurs in manufacturing, so that it is possible to light the optical modulation element at a constant luminance level.

Further, in the memory-integrated display element according to the present invention, the output inverter may be a complementary inverter such as a CMOS (Complementary MOS).

According to the structure, in a case where the memory element stores binary data such as light/light-off, one of the switching elements that make up the complementary inverter (for example, the combination of a p type transistor and an n type transistor), is conducted. Thus, even though the electric charge is stored in the optical modulation element in a certain display state, the left electric charge is emitted quickly via the conducted switching element, and the optical modulation element can shift to the next display state quickly. Thus, it is possible to restrict occurrence of a display error, or the burning and the deterioration of the optical modulation element.

Further, in addition to the structure in which the complementary inverter is provided as the output inverter, the memory-integrated display element according to the present invention may be arranged as follows. The complementary inverter includes: a p type transistor connected to a first power line; and an n type transistor connected to a second power line, and an anode of the optical modulation element is connected to an output end of the output inverter, and a cathode of the optical modulation element is connected to the second power line, and when a ratio of an OFF resistance value of the n type transistor with respect to an ON resistance value of the p type transistor is K, and a dispersion quantity of the lighting luminance of the optical modulation element is within ±x % with respect to a reference value, a ratio of an ON resistance value of the p type transistor with respect to an ON resistance of the optical modulation element is set to be a range from $(K+1)^{1/2}\cdot(1-x/100)/K$ to $(K+1)^{1/2}\cdot(1+x/100)/K$.

According to the foregoing connection, in the case where the respective resistance values are set as described above, when the p type transistor and the optical modulation element are conducted and the n type transistor is shut off, the power consumption of the output inverter and the optical modulation element is substantially minimized. While, in a case where the optical modulation element is shut off, the resistance value becomes sufficiently large, compared with a conducting state of the optical modulation element. Further, since the p type transistor is shut off and the n type transistor is conducted, a voltage applied to the optical modulation element is substantially 0, so that the power consumption of the output inverter and the optical modulation element is small, compared with the conducting state of the optical modulation element. Thus, it is possible to reduce the power consumption of the memory-integrated display element by setting the respective resistance value as described above.

Further, in the structure in which the output inverter is the complementary inverter, the memory-integrated display element according to the present invention may be arranged as follows. The complementary inverter includes: a p type transistor connected to a first power line; and an n type transistor connected to a second power line, and a cathode of the optical modulation element is connected to an output end of the output inverter, and an anode of the optical modulation element is connected to the first power line, and when a ratio of the OFF resistance value of the p type transistor with respect to an ON resistance value of the n type transistor is K, and a dispersion quantity of lighting luminance of the optical modulation element is within ±x % with respect to the reference value, a ratio of an ON resistance value of the n type transistor with respect to an ON resistance of the optical modulation element is set to be a range from $(K+1)^{1/2}\cdot(1-x/100)/K$ to $(K+1)^{1/2}\cdot(1+x/100)/K$.

According to the foregoing connection, in the case where the respective resistance values are set as described above, when the n type transistor and the optical modulation element are conducted and the p type transistor is shut off, the power consumption of the output inverter and the optical modulation element is substantially minimized. Further, as in the case where the cathode is connected to the second power line, the power consumption is sufficiently small, when the optical modulation element is shut off. Thus, it is possible to reduce the power consumption of the memory-integrated display element by setting the respective resistance values as described above.

For a fuller understanding of the nature and advantages of the invention, reference should be made to the ensuing detailed description taken in conjunction with the accompanying drawings.

BRIEF DESCRIPTION OF THE DRAWINGS

FIG. 6 is an explanatory drawing showing the relationship of the parameter alpha ($\alpha$) with the ON resistance value and the OFF resistance value of the TFT.

DESCRIPTION OF THE EMBODIMENT

Figure 1:
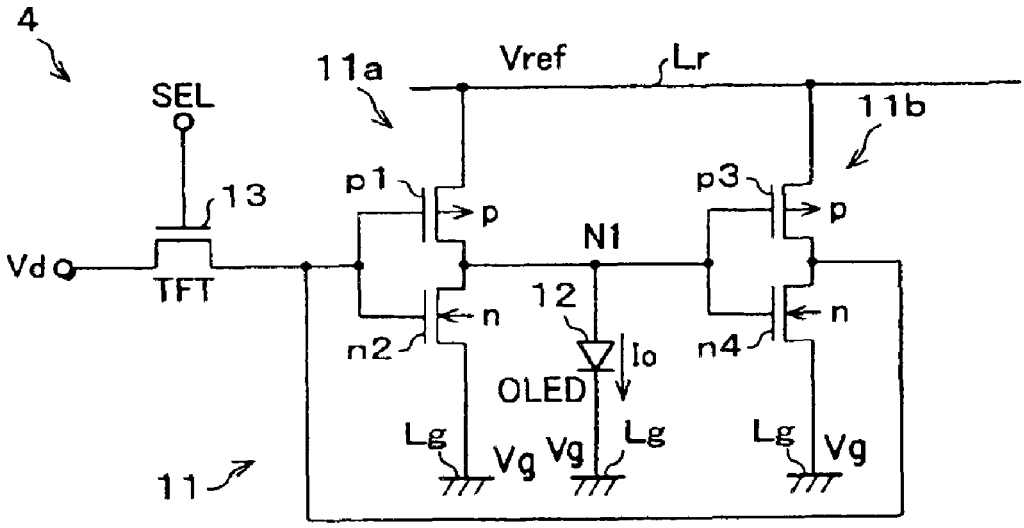
FIG. 1 shows one embodiment of the present invention, and is a circuit diagram showing a structure of an important part of a pixel.

One embodiment of the present invention is described based on FIG. 1 to FIG. 17 as follows. That is, a display element 1 according to the present embodiment is a display element in which an OLED (Organic Light Emission Diode), which functions as an optical modulation element, is provided in a matrix manner. As shown in FIG. 2, the display element 1 includes: plural data lines 2(1) to 2(M) provided in parallel to each other; plural select lines 3(1) to 3(N) provided so as to cross the data lines 2(1) to 2(M) at right angle; pixels 4(1,l) to 4(N,M) provided on crossing points of the data lines 2(1) to 2(M) and the select lines 3(1) to 3(N) respectively; a column address decoder 5 connected to respective data lines 2(1) to 2(M); a row address decoder 6 for driving respective select lines 3(1) to 3(N); and a control circuit 7 for controlling both the decoders 5 and 6.

Concretely, as described later, each of the pixels 4(i,j) includes a memory circuit 11 (described later), which stores whether the pixel 4(i,j) is ON or OFF. The memory circuit 11 is connected via the data line 2(j), to which the memory circuit 11 itself is connected, to the column address decoder 5, in a select period in which the row address decoder 6 is applying a potential, whose select level has been set in advance, to the select line 3(i), to which the memory circuit 11 itself is connected, and it is possible to access (read and write) the content of the memory circuit 11 from the column address decoder 5. Further, it is possible that the memory circuit 11 is separated from the data line 2(j) during a non-select period, which is a period other than a select period, and stores a value (ON or OFF) written in the select period, so as to continue to apply the value to the OLED 12 which functions as the optical modulation element.

Figure 20:
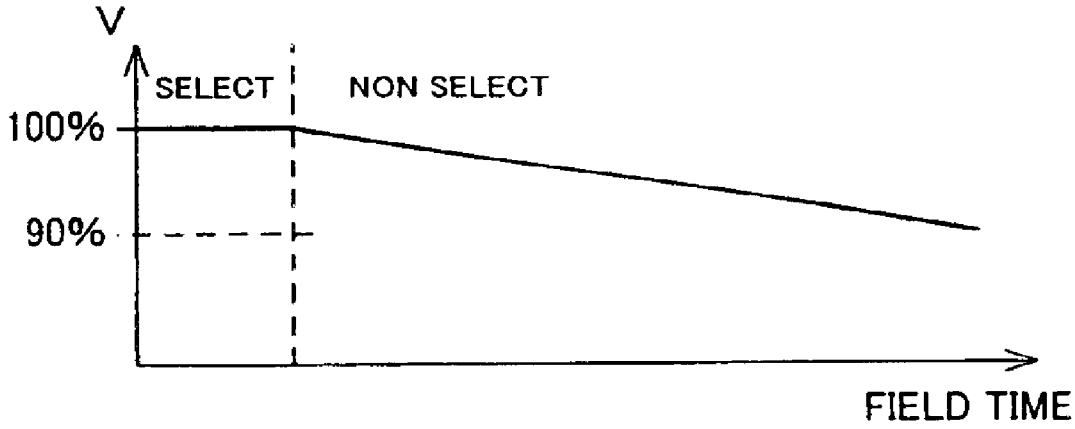
FIG. 20 PRIOR ART
FIG. 20 is a graph showing the change with time of potential stored by a memory element, in the prior art pixel.

Here, in a case where the pixel 4(i,j) does not have the memory circuit 11, or in a case where the pixel 4(i,j) has an analog type memory circuit such as a sample hold circuit, as shown in FIG. 20, a voltage, applied in the select period, continues to decline in the non-select period. Thus, even though the display state of the pixel 4(i,j) does not change, it is required to restore a select potential by selecting the pixel 4(i,j), until the decline of the voltage affects the display state, for example, until a predetermined cycle comes. As a result, there is such possibility that the number of the pixels(i,j), which should be selected, increases per a unit time, and a time (duty ratio), required in selecting one pixel 4(i,j) per a unit time, declines.

Figure 3:
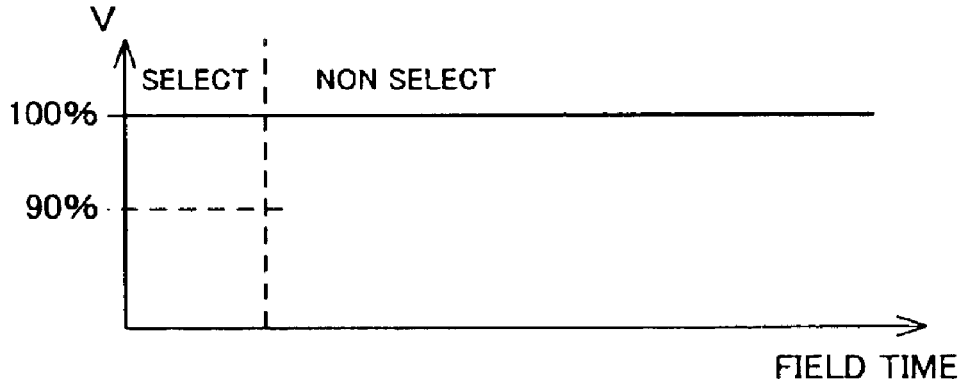
FIG. 3 is a graph showing a time change of a potential stored by a memory element in the pixel.

Unlike the foregoing prior art, since the pixel 4(i,j) according to the present embodiment includes the memory circuit 11 for storing an ON state or an OFF state, as shown in FIG. 3, in the non-select period, it is possible to continue to store a voltage which indicates how the voltage has been applied in the select period. As a result, when the display state of the pixel 4(i,j) is not changed, it is not required to select the pixel 4(i,j). As a result, even though the display element 1 has many pixels and high resolution, it is possible to restrict the decline of the duty ratio. Further, since only the required part needs renewing, it is possible to reduce the power consumption compared with a case where writing is performed with respect to all the pixels, regardless of whether the display state is changed or not. Note that, hereinbelow, particularly, in a case where it is not important to specify a position in a matrix, for example, arbitrary pixel 4(i,j) is referred to as a pixel 4.

Figure 2:
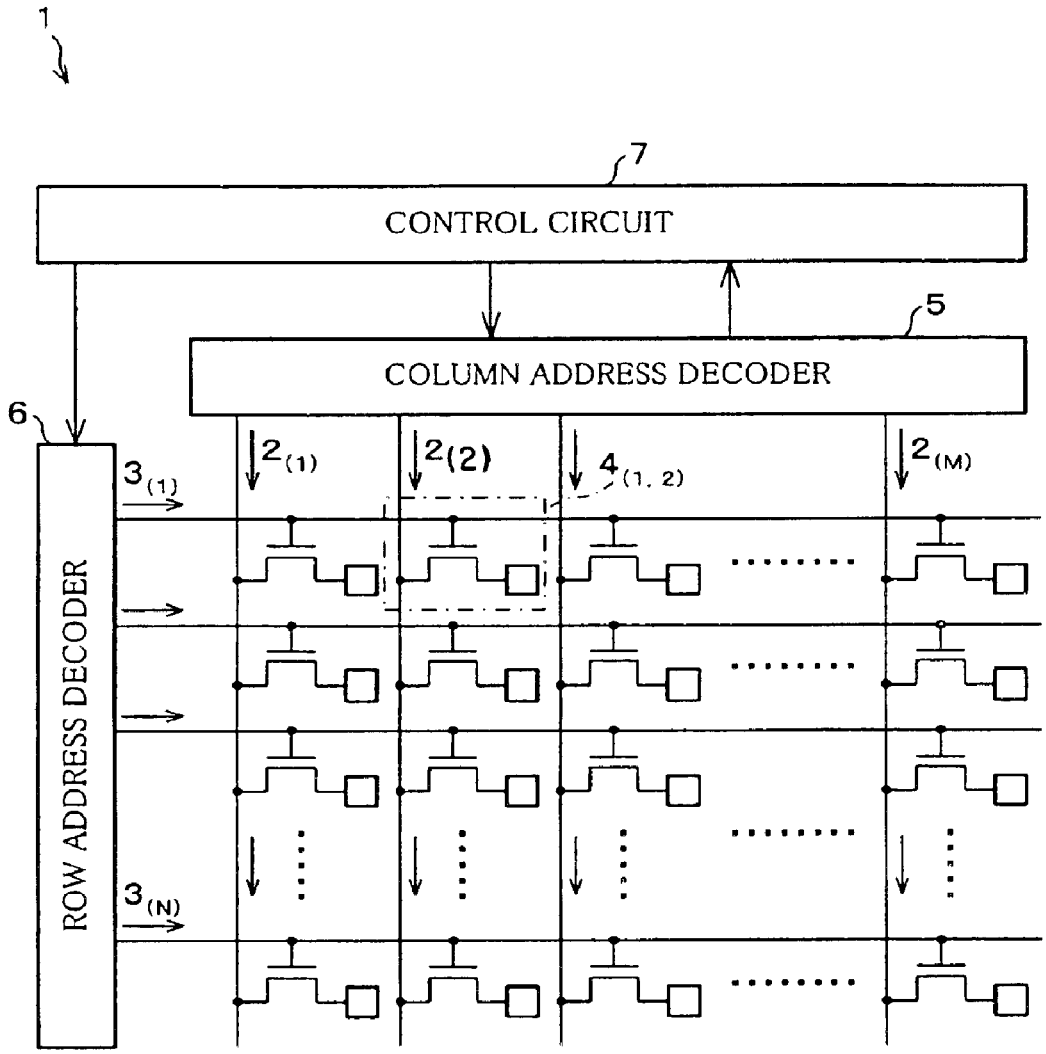
FIG. 2 is a block diagram showing an arrangement of an important part of a display element which includes the pixel.

Concretely, the pixel 4 according to the present embodiment, as shown in FIG. 1, includes: a memory circuit 11 made of a static RAM which is arranged by connecting inverters 11*a* and 11*b*, having CMOS structures, to each other in a loop manner; and an OLED 12 in which an anode terminal is connected to an output end of the memory circuit 11, such as an inversion output end (output end of the inverter 11*a*) N1, and a cathode is grounded. Further, an input end of the memory circuit 11 (input end of the inverter 11*a*) is connected via a select circuit 13 to a data line 2 corresponding to the pixel 4, and it is possible to apply a data potential Vd of the data line 2 when the select circuit is conducted. The select circuit 13 is made of, for example, a thin film transistor (TFT) etc., and conduction/cutoff of the select circuit 13 is controlled by a select signal SEL which is applied by the select line 3 corresponding to the pixel 4.

The inverter 11*a* is made of a p type TFTp1 and an n type TFTn2, both of which complement each other, and gates of both the TFTp1 and TFTn2, which function as an input end, are connected to the select circuit 13, and drains of both the TFTp1 and TFTn2, which function as an output end, are connected to the inverter 11*b* of the following stage. Further, a source of the TFTp1 is connected to a power line (first power line) Lr, to which a predetermined reference potential Vref [V] is applied, and a source of the TFTn2 is connected to a ground line (second power line) Lg.

While, also the inverter 11*b* of the following stage, which is connected to the inverter 11*a* in cascade, is made of a p type TFTp3 and an n type TFTn4, both of which complement each other, and gates of both the TFTp3 and TFTn4, which function as an input end, are connected to the output end of the inverter 11*a* (drains of the TFTp1 and the TFTn2 ), and drains of both the TFTp3 and TFTn4, which function as an output end, are returned to the input end of the inverter 11*a* (gates of the TFTp1 and the TFTn2 ). Note that, sources of the TFTp3 and the TFTn4 are connected to the power line Lr and the ground line Lg, as in the inverter 11*a*.

Note that, in the arrangement of FIG. 1, since the OLED 12 is connected to the output end N1 of the inverter 11*a*, the inverter 11*a* corresponds to an output inverter recited in claims. Further, the TFTp1 of the inverter 11*a* corresponds to a p type transistor, and the TFTn2 corresponds to an n type transistor and electric charge emitting means.

According to the present embodiment, for example, the OLED 12 and the memory circuit 11 are formed within a surface of the same level layer, and a cathode electrode of the OLED 12 is made of a wire whose conductivity is high such as an aluminum, so as to integrate the ground line Lg of the memory circuit 11 and the ground line Lg of the OLED 12, but they may be formed separately. However, even in a case where the OLED 12 and the memory circuit 11 of a certain pixel 4 do not have a common electrode, it is possible to form the ground line of the OLED 12 on a layer different from another layer, on which the ground line and the power line of the memory circuit 11 are formed, and to use the ground line of the OLED 12 of the pixels 4 as the common electrode, for example, by providing the ground line of the OLED 12 opposite to a substrate, on which the memory circuit 11 is formed, with an insulating film etc. between the ground line of the OLED 12 and the substrate. In any case, when a common electrode shared by the ground line of the OLED 12 of the pixel 4 and the ground line of the memory circuit 11 of the pixel 4 is formed, and/or when a common electrode shared by the ground line of the OLED 12 of the pixel 4 and the ground line of the OLED 12 of another pixel 4, it is possible to simplify an area occupied by wires and manufacturing processes, and to improve the aperture ratio of the pixel 4.

According to the foregoing structure, the select circuit 13 is conducted, and a potential of the data line 2 (data potential Vd) is applied to the input end of the memory circuit 11 in the select period. Thus, in each inverter 11*a* (11*b*) of the memory circuit 11, either of the TFTp1 and the TFTn2 (the TFTn4 and the TFTp3) is conducted, and a potential of the inversion output end N1 becomes a value corresponding to the data potential Vd, one of the binary of the reference potential Vref and the ground level. Note that, since current driving performance of the column address decoder 5 is set to be much higher than current driving performance of the inverter 11*b*, the potential of the inversion output end N1 becomes a value corresponding to the data potential Vd, regardless of a value which has been stored by the memory circuit 11.

In the memory circuit 11, since both the inverters 11*a* and 11*b* are connected to each other in a loop manner, in both the inverters 11*a* and 11*b*, conduction/cutoff states of both the TFTp1 and the TFTn2 (the TFTn4 and the TFTp3) are kept even after the select period is over, while the select circuit 13 is shut off (non-select period). As a result, the potential of the inversion output end N1 is kept to be the same potential as a potential at a time when the select circuit 13 is shut off, and the potential is either of the binary of the reference potential Vref and the ground potential Vg. Thus, light/light-off of the OLED 12 is controlled by the data potential Vd applied in the select period, and in a case where the data potential Vd indicates ON (in the inversion output end N1, the reference potential Vref), the OLED 12 continues to light during the non-select period. Further, in a case where the data potential Vd indicates OFF (in the inversion output end N1, the ground potential Vg), light-off can be kept.

Note that, in the foregoing description, it is described that the column address decoder 5 writes data indicative of light/light-off in the memory circuit 11 of a pixel 4 selected by the row address decoder 6. Since the memory circuit 11 and the column address decoder 5 are connected to each other in the select period, it is possible to read the content of the memory circuit 11. In this case, since the column address decoder 5 judges the content of the memory circuit 11 by an input circuit whose input impedance is so large that a potential level of a signal, returned in the inverter 11*b*, is not changed, it is possible to read the content of the memory circuit 11 without changing the content of the memory circuit 11.

Further, in a case where data is read, in the respective pixels 4 including a pixel 4 which is reading data, since each memory circuit 11 stores the display state of itself, it is possible to continue to display images without any trouble. Further, in the display element 1, the respective data lines 2(1) to 2(M) are provided independently, and circuits, which access the data lines 2(1) to 2(M), are also provided independently in the column address decoder 5. Thus, the column address decoder 5 may simultaneously write data in all the pixels 4 which are being selected, and also can simultaneously read data. Further, it is possible to write data in a certain pixel 4(i,j) and to read the content from the memory circuit 11 of another pixel 4(i,k) at the same time.

Figure 4A:
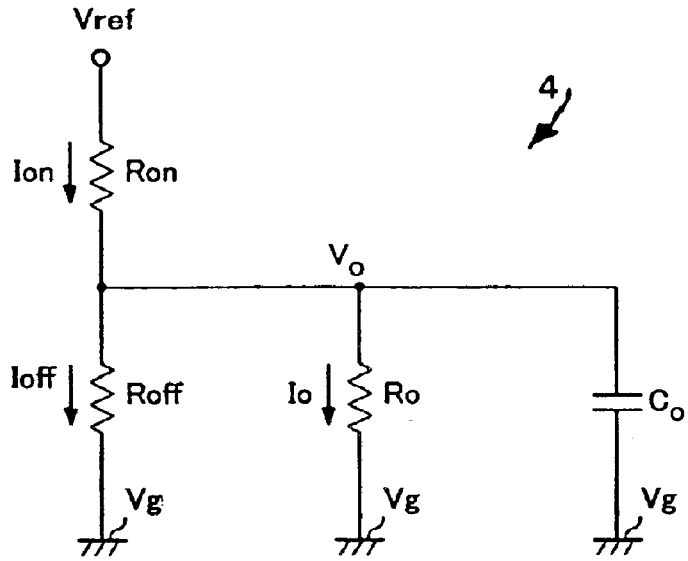
FIGS. 4A and 4B illustrate circuit diagrams showing equivalent circuits of the pixel.

Here, in the case where the OLED 12 is ON, in the inverter 11*a* for driving the OLED 12, an equivalent circuit of a circuit for supplying a current to the OLED 12, as shown in FIG. 4A, has a structure in which a resistor Ron, connected to the reference potential Vref, is grounded via parallel circuits: a resistor Roff, a resistor Ro, and a capacitor Co. Note that, in the equivalent circuit of FIG. 4A, the inverter 11*b*, provided in the following stage, in which the gates of the TFTp3 and the TFTn4 function as the input ends, has higher input impedance, compared with the resistor Ron, the resistor Roff, the resistor Ro, and the capacitor Co, and does not influence the analysis of the power consumption, so that illustration thereof is omitted. Further, the resistor Ron and the resistor Roff[Ω] of FIG. 4A correspond to an ON resistor of the TFTp1 and an OFF resistor of the TFTn2, respectively. Further, the resistor Ro[Ω] and the capacitor Co[F] correspond to resistance component and capacitance component of the OLED 12.

In the equivalent circuit, the power consumption P[W] of the pixel 4 is expressed by the following expression (1).

$$P=Vref^2/(Ron+Roff\cdot Ro/(Roff+Ro)) \quad (1)$$

While, since a voltage Vo, applied to the OLED 12, is set to be a desired luminance value in a case where the OLED 12 is ON, it is required to set the reference potential Vref so that a voltage divided by the resistors Ron and Roff of the reference potential Vref is a predetermined voltage Vo, when the applied voltage Vo is a constant value regardless of the resistance value of the TFTp1 and the TFTn1.

Here, in accordance with a relative value A (=Ron/Ro) of an ON resistance value Ron of the TFTp1 with respect to an ON resistance value Ro of the OLED 12, a relative value B (=Roff/Ro) of an OFF resistance value Roff of the TFTn2, and Vo=Vref·(Roff·Ro/(Roff+Ro))/(Ron+Roff·Ro/(Roff+Ro)), the foregoing expression (1) is replaced with the following expression (2).

$$P\cdot Ro/Vo^2=(A+(B/(B+1)))/(B/(B+1))^2=\alpha \quad (2)$$

Note that, in the expression (2), since the resistance value Ro and the voltage Vo are fixed, there is direct proportionality between the power consumption P and a substitute mark α on the right side of the expression (2) so that the power consumption P changes, and the power consumption P is minimum when the parameter α is minimum.

Further, a value of the parameter α in a case of changing the relative values A and B respectively is, for example, as shown in FIG. 6. When the relative value A is lowered and the relative value B is heightened, the power consumption P can be reduced. For example, in a case where the OFF resistance value Roff of the n type TFTn2 is as 1000 times large as the ON resistance value Ro of the OLED 12, it is possible to avoid consuming unnecessary power other than power required in a luminous section (OLED 12) when the ON resistance value Ron of the p type TFTp1 is not more than 0.2 times with respect to the resistance value Ro.

Figure 5:
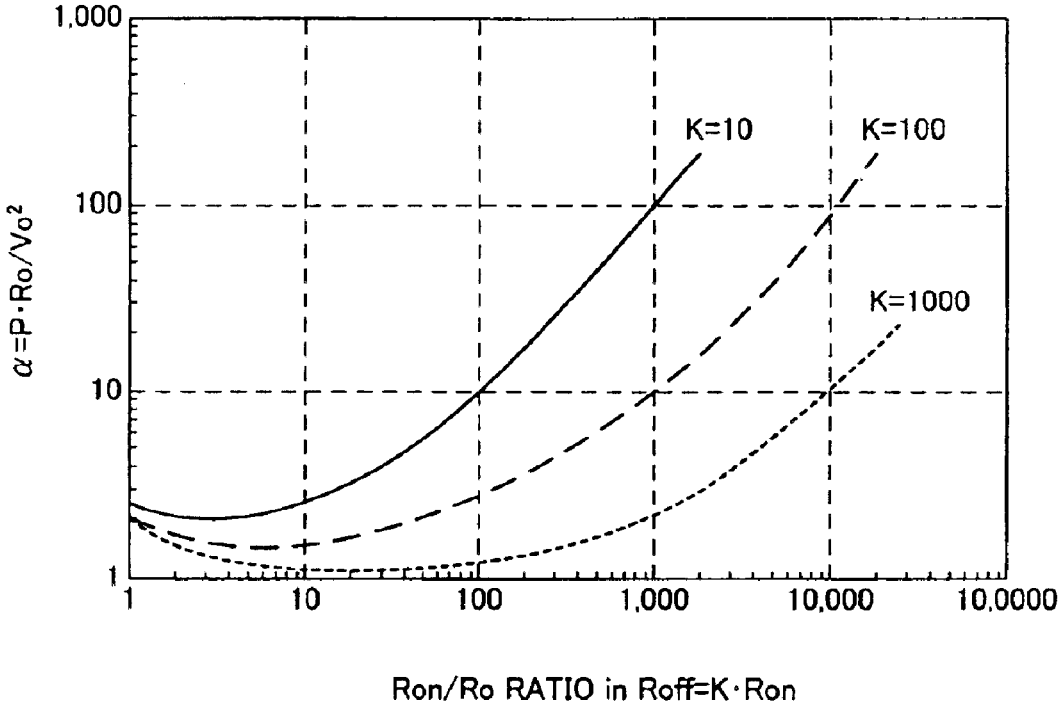
FIG. 5 is a graph showing each relation between a power consumption of the pixel and an OFF resistance value in a case where a ratio of an ON resistance value and the OFF resistance value of a TFT is set to be a certain value.

Here, a ratio of the OFF resistance value of the n type TFT with respect to the ON resistance value of the p type TFT is restricted by a manufacturing method and materials, or by the size and a structure of the TFT. Thus, when a ratio of the OFF resistance value of the n type TFT with respect to the ON resistance value of the p type TFT is K (=B/A), and relation between the parameter α, which indicates the power consumption, and the relative value A is illustrated with respect to some Ks, the illustration is as shown in FIG. 5. Note that, FIG. 5 illustrates cases where the OFF resistance of the n type TFT is as 10 times, 100 times, and 1000 times large as the ON resistance of the p type TFT (K=10, 100, 1000).

Further, when K•A is substituted for B (K•A=B) of the expression (2), and the relative value A, at a time when the parameter a is minimum, is calculated, the resultant is as follows.

$$d\alpha/dA = 1 - ((K+1)/K^2)\cdot(1/A^2) = 0 \quad (3)$$

This leads to the following expression (4).

$$A=(K=1)^{1/2}/K \quad (4)$$

As a result, for example, in a case of K=100, the ON resistance value Ron of the TFTp1 is set to be about as 0.10 times as large as the ON resistance Ro of the OLED 12, and in a case of K=1000, the resistance Ron is set to be about as 0.032 times large as the resistance Ro, so that it is possible to minimize the power consumption in the pixel 4. Note that, as long as the increase of the power consumption, brought about by deviation from the most appropriate value, is within tolerance such as a few percent, the ON resistance Ron may be set to be a bit away from the foregoing value.

As an example of the tolerance, the following is a description of a case where the luminance of each pixel 4 is set so that the luminance variation (dispersion) with respect to the designed value is ±x %. Here, a current/luminance characteristic of the OLED 12 is substantially linear. Thus, in a case where a voltage, applied to the pixel 4, is constant, when the luminance variation with respect to a setted value is ±x %, a current variation with respect to an average of a current supplied in the OLED 12 also becomes ±x %, and a power variation with respect to an average of power consumed in the OLED 12 also becomes ±x %. Further, when the applied voltage is constant, in the ON resistance of the OLED 12, Ro is an average. The ON resistance of the OLED 12 have the dispersion which approximates ±x % with respect to Ro. In this case, the foregoing expression (1) becomes the following expression (5).

$$P=Vref^2/(Ron+Roff\cdot Ro\cdot X/(Roff+Ro\cdot X)) \quad (5)$$

Note that, in the expression (5), X indicates variation of the ON resistance of the OLED 12, and X=1±x/100.

As described above, the voltage Vo applied to the OLED 12 is set to be a substantially constant value, so that, like the expressions (1) and (2), the expression (5) is replaced with the following expression (6), in accordance with the relative value A=Ron/Ro and B=Roff/Ro, and Vo=Vref·(Roff·Ro·X/(Roff+Ro·X))/(Ron+Roff·Ro·X/(Roff+Ro·X)).

$$P\cdot Ro/Vo^2 = (A+(B\cdot X/(B+X)))/(B/(B+X))^2 = \alpha \quad (6)$$

Further, substantially like the expression (3), K·A is substituted for B (K·A=B) in the expression (6), and the relative value A, which minimizes the parameter α, is calculated as follows.

$$d\alpha/dA = 1/X^2 - ((K+1)/K^2)\cdot(1/A^2) = 0 \quad (7)$$

Then, when the following expression (8) is formed, the power consumption P of the pixel 4 is minimized.

$$A=(K+1)^{1/2}\cdot(1\pm x/100)/K \quad (8)$$

Thus, when the relative value A is within a range shown in the following expression (9), it is possible to keep the dispersion of the lighting luminance of the pixel 4 within ±x % with respect to the reference value.

$$(K+1)^{1/2}\cdot(1-x/100)/K \leqq A \leqq (K+1)^{1/2}\cdot(1+x/100)/K \quad (9)$$

In the same way, when a condition shown in the following expression (10) is satisfied, it is possible to keep the dispersion of the lighting luminance of the pixel 4 within ±x % with respect to the reference value.

$$(K+1)^{1/2}\cdot(1-x/100) \leqq B \leqq (K+1)^{1/2}\cdot(1+x/100) \quad (10)$$

Figure 21:
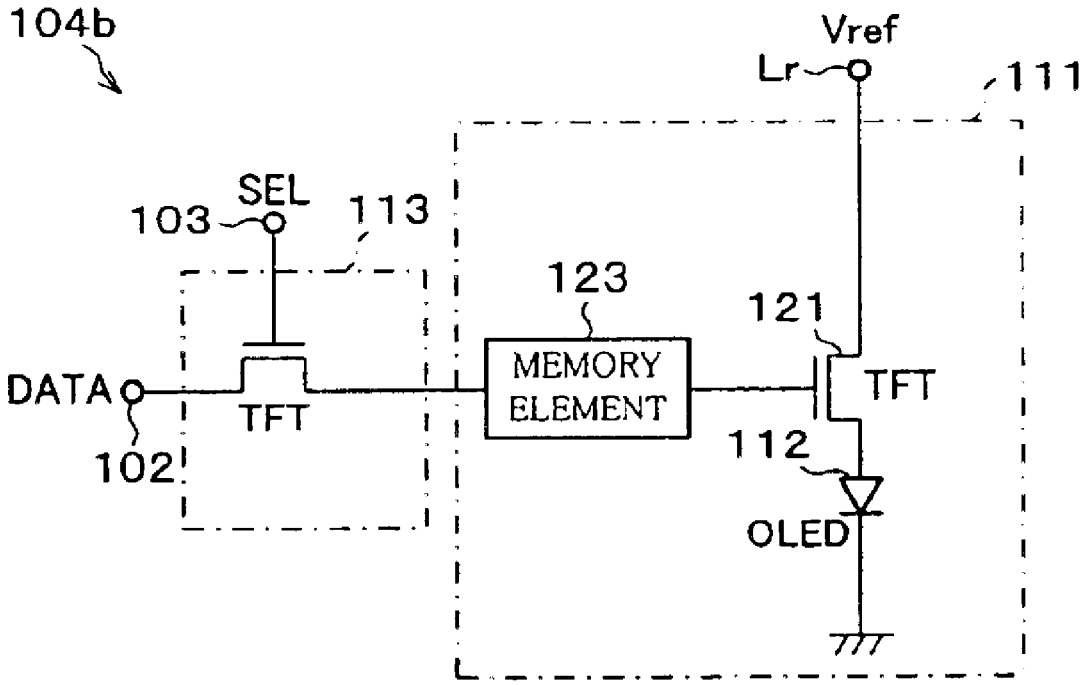
FIG. 21 PRIOR ART
FIG. 21 shows still another prior art, and is a block diagram showing a structure of an important part of a pixel.

According to the foregoing structure, unlike the prior art shown in FIG. 21, the OLED 12, which functions as an optical modulation element, is directly connected to the output end (inversion output end N1) of the memory circuit 11, and instead of the TFT 121 for drive shown in FIG. 21, the TFTp1 of the memory circuit 11 ON-drives the OLED 12. Thus, compared with the structure shown in FIG. 21, the number of elements can be reduced since the TFT 121 is not required, and the aperture ratio of the pixel 4 can be improved.

Figure 7:
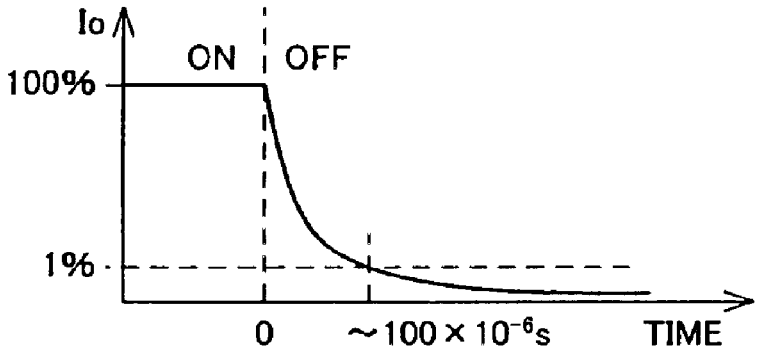
FIG. 7 is a graph showing a characteristic of a current left in an LED (OLED), in a prior art shown in FIG. 21.

Further, according to the structure of FIG. 21, since a pixel shifts from the ON state to the OFF state, the electric charge, stored in the anode of the OLED 12, is not emitted quickly in the ON state due to the capacitance component of an LED 112 even though the TFT 121 is shut off, and as shown in FIG. 7, a current is applied to the LED 112 even after the TFT 121 is shut off.

Here, in a case where an optical modulation element of the pixel is liquid crystal, even though a voltage, applied to the optical modulation element, is a bit varied due to the left charge, change of the hue and display burning, which occur in the pixel, or deterioration of the optical modulation element are likely not to bring about any problem. However, in a case where an LED or an OLED is used as the optical modulation element, the luminous intensity varies according to a quantity of a current, and according to an exponential function of the applied voltage, so that there is a possibility that the large dispersion of the luminance occurs even though the voltage varies a bit.

Thus, in a case where a preceding field is ON (bright) and a following field is OFF (dark), afterglow remains in the pixel for a certain period (in an example of FIG. 7, for 100μ seconds). Particularly, when the storage of the electric charge brings about the afterglow, there is a possibility that the number of pixels becomes large, so that a display error occurs in a display element which is high-frequency-driven. As a result, desired luminance is not realized in the display of the pixel, and the hue varies. Further, when the electric charge is stored in the OLED (LED), there is a possibility that the storage causes the burning and the deterioration of the element.

Figure 8:
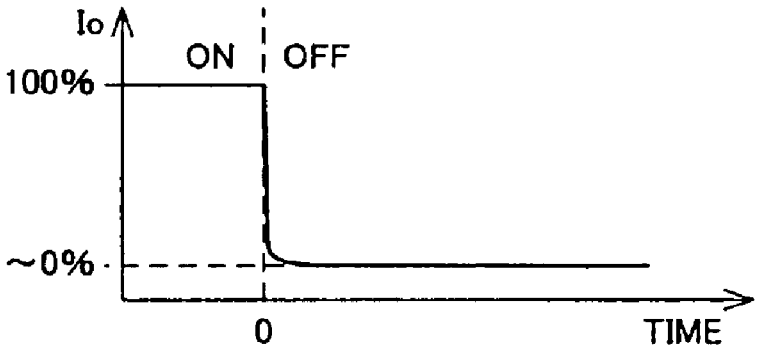
FIG. 8 is a graph showing a characteristic of a current left in an OLED, in the pixel shown in FIG. 1.

Unlike the foregoing prior art, according to the structure shown in FIG. 1, the memory circuit 11 is a static memory in which the inverters 11*a* and 11*b* are provided in a loop manner, and the TFTp1 and the TFTn2, both of which complement each other, drive the OLED 12. Thus, when the pixel 4 shifts from the ON state to the OFF state, the TFTn2 is conducted with cutoff of the TFTp1. As a result, even though the electric charge is stored in the anode of the OLED 12 during the ON state, the electric charge is emitted via the TFTn2 to the ground line Lg. Thus, even though the current drive type OLED 12 is used as the optical modulation element, as shown in FIG. 8, it is possible to realize a characteristic of a quick optical response. This does not permit the gradation error in dark display, which results from the left electric charge, to occur, and it is possible to restrict the change of the hue and the display burning due to the left electric charge, or deterioration of the OLED 12.

Further, in the present embodiment, as described above, the ON resistance Ron of the TFTp1 and the OFF resistance Roff of the TFTn2 are set. Thus, despite of using the optical modulation element, which is likely to consume unnecessary power in the pixel 4 when the resistance value of the TFT is not balanced with the resistance value of the OLED 12 appropriately, that is, despite of using a current operation type OLED 12, it is possible to reduce the power consumption P in the case where the OLED 12 is ON. Note that, in the OFF state, the OLED 12 is shut off, so that a current is not applied between the power line Lr and the ground line Lg, after the TFTp1 to the TFTn4 of the respective inverters 11*a* and 11*b* shift to the steady state. Thus, the power consumption of the pixel 4 in the OFF state is kept low.

Figure 9:
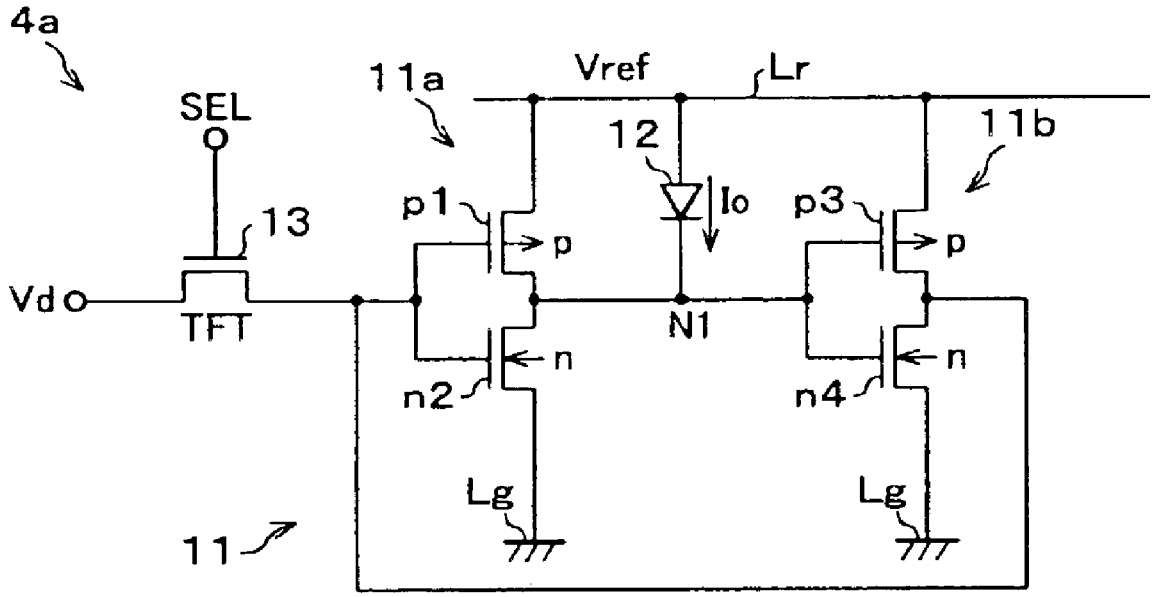
FIG. 9 shows a modified example of the embodiment, and is a circuit diagram showing a structure of an important part of a pixel.

Incidentally, as to the pixel 4 shown in FIG. 1, the case, where the OLED 12 is provided between the inversion output end N1 and the ground line of the memory circuit 11, is described, but like the pixel 4*a* shown in FIG. 9, the OLED 12 may be provided between the inversion output end N1 and the power line Lr.

In this case, unlike the pixel 4, the OLED 12 lights while the memory circuit 11 keeps the inversion output end N1 at a ground level, that is, while the TFTp1 is shut off and the TFTn2 is conducted. Further, the OLED 12 unlights while the inversion output end N1 is kept at the reference potential Vref, that is, while the TFTp1 is conducted and the TFTn2 is shut off. Note that, in this example, when the OLED 12 unlights, the TFTp1 is conducted, so that the TFTp1 corresponds to the electric charge emitting means recited in claims.

Figure 4B:
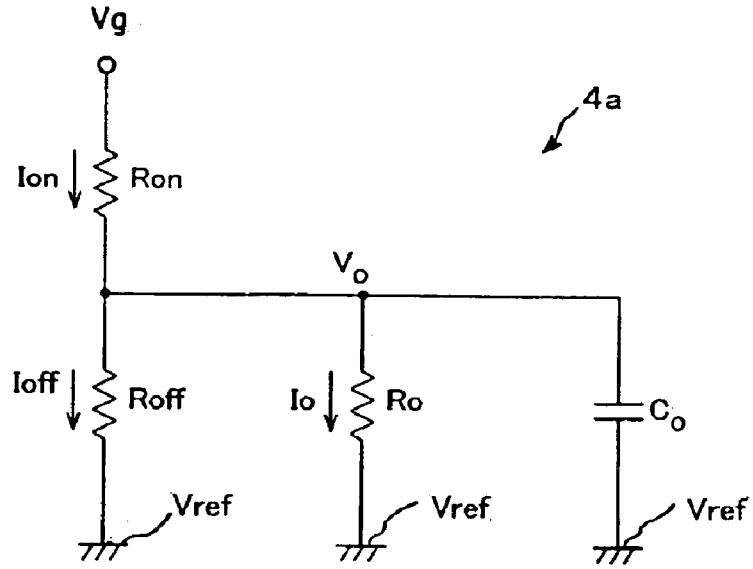

Further, when the OLED 12 lights, an equivalent circuit of a circuit for supplying a current, as shown in FIG. 4B, is a circuit in which the ground line Lg and the power line Lr of the equivalent circuit of the pixel 4 are replaced with each other. Thus, when the ON resistance of the TFTn2 is Ron and the OFF resistance of the TFTp1 is Roff, the expressions (1) to (4) are applied to the power consumption of the pixel 4*a*. Thus, when a ratio of the OFF resistance value Roff of the p type TFT with respect to the ON resistance value Ron of the n type TFT is K, the ratio A of the ON resistance value Ron of the n type TFT with respect to the ON resistance value Ro of the OLED 12 is set to be $(K+1)^{1/2}/K$, so that it is possible to set the power consumption of the pixel 4*a* to be minimized.

Even in the structure, the OLED 12, which functions as the optical modulation element, is directly connected to an output end (inversion output end N1) of the memory circuit 11, and the TFTn2 of the memory circuit 11 ON-drives the OLED 12, so that, like the pixel 4 of FIG. 1, the number of elements can be reduced, and the aperture ratio of the pixel 4*a* can be improved.

Further, when the pixel 4*a* shifts from the ON state to the OFF state, the TFTp1 is conducted with the cutoff of the TFTn2. As a result, even though electric charge is stored in the cathode of the OLED 12 during the ON state, the electric charge is emitted via the TFTp1 to the power line Lr. Thus, like the pixel 4 of FIG. 1, even though the current drive type OLED 12 is used as the optical modulation element, as shown in FIG. 8, it is possible to realize a characteristic of a quick optical response, and to restrict the change of the hue and the display burning due to the left electric charge, or deterioration of the OLED 12.

Further, in the present embodiment, as described above, the ON resistance value Ron of the TFTn2 and the OFF resistance value Roff of the TFTp1 are set. Thus, even though the current operation type OLED 12 is used, it is possible to reduce the power consumption of the pixel 4*a*.

Figure 10:
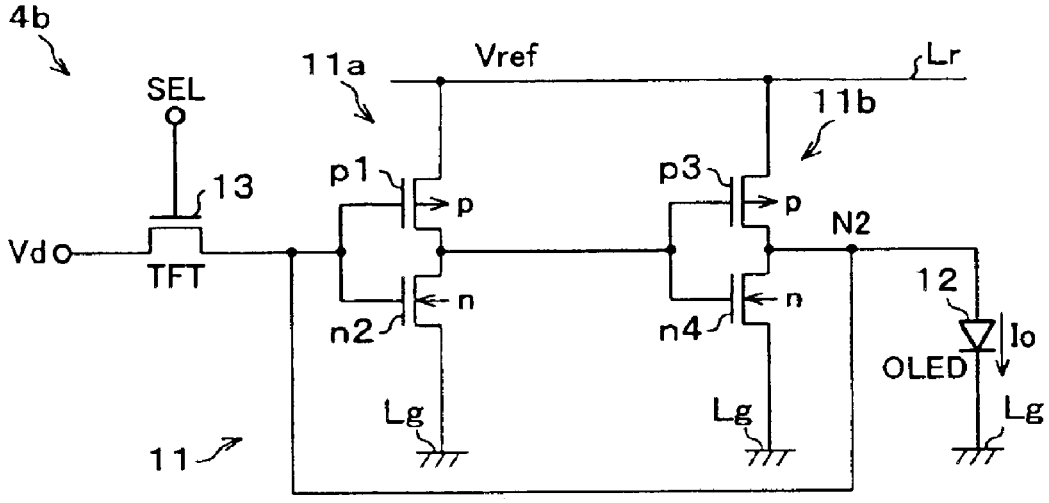
FIG. 10 shows another modified example of the embodiment, and is a circuit diagram showing a structure of an important part of a pixel.

Further, in FIG. 1 and FIG. 9, the case, where the OLED 12 is connected to the inversion output end N1 used as an output end of the memory circuit 11, is described, but like a pixel 4*b* shown in FIG. 10, it is possible to obtain the same effect also in a case where the OLED 12 is connected to a non-inversion output end N2 (output end of the inverter 11*b*) of a feed back line portion.

Note that, as in FIG. 9, the OLED 12 may be provided between the output end and the power line Lr, but FIG. 10 shows, as in FIG. 1, a case where the OLED 12 is provided between the output end and the ground line Lg. Further, according to the structure of FIG. 10, the output end of the inverter 11*b* is connected to the OLED 12, and when the OLED 12 unlights, the TFTn4 is conducted, so that the inverter 11*b* corresponds to an output inverter recited in claims, and the TFTp3 corresponds to a p type transistor, and the TFTn4 corresponds to an n type transistor and the electric charge emitting means.

Figure 11:
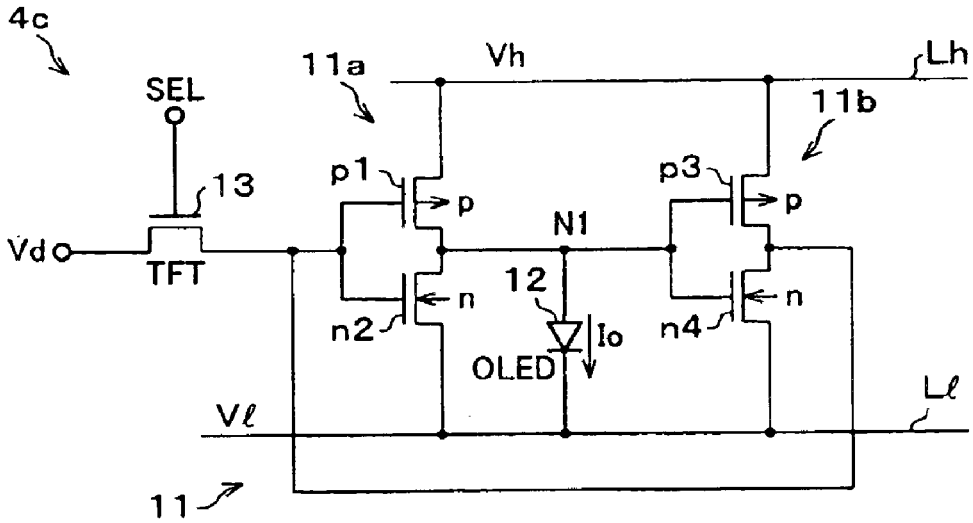
FIG. 11 shows still another modified example of the embodiment, and is a circuit diagram showing a structure of an important part of a pixel.
Figure 12:
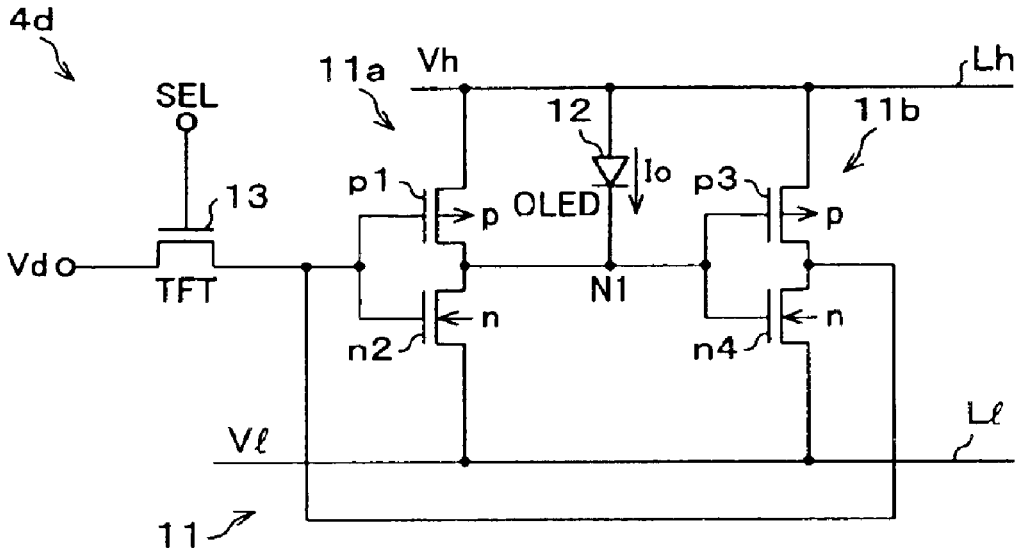
FIG. 12 shows another modified example of the embodiment, and is a circuit diagram showing a structure of an important part of a pixel.

While, in FIG. 1, FIG. 9, and FIG. 10, the case, where the reference potential Vref and the ground level are supplied to the pixels 4, 4*a*, and 4*b*, is described, but like a pixel 4*c* (4*d*) shown in FIG. 11 (FIG. 12), positive and negative power voltages Vh and Vl, instead of the reference potential Vref and the ground level, may be supplied. In this case, the memory circuit 11 is driven by the positive and negative power voltages Vh and Vl, applied in the power lines Lh and Ll which function as the first and second power lines, so that, in addition to the effects brought about by the pixels 4 to 4*b*, it is possible to operate the memory circuit 11 more steadily. Note that, in this case, compared with the structures of FIG. 1, FIG. 9, and FIG. 10, the potential levels of the power are changed from the reference potential Vref and the ground level to the positive and negative power voltages Vh and Vl, but as long as difference of the potentials is the same, the power consumption P is the same, so that it is possible to set the power consumption to be the minimum value by setting the ON resistance values Ron and Roff of the respective TFT as in the foregoing setting.

Figure 13:
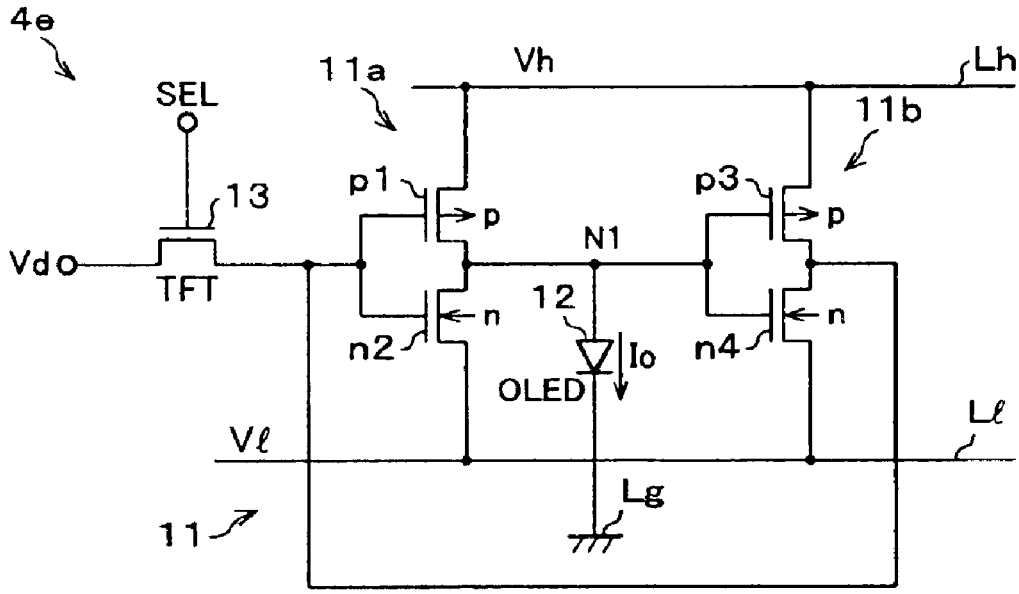
FIG. 13 shows still another modified example of the embodiment, and is a circuit diagram showing a structure of an important part of a pixel.
Figure 14:
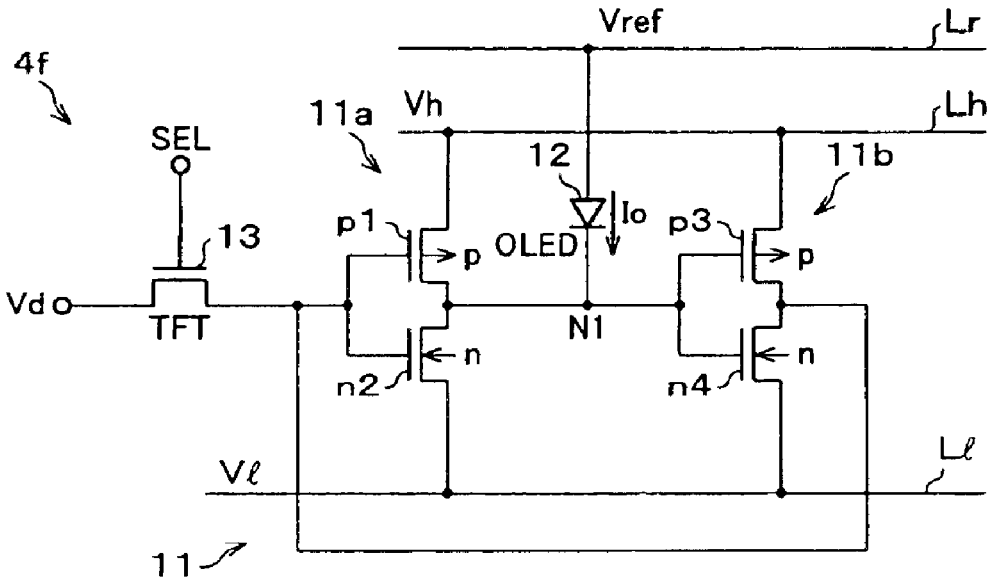
FIG. 14 shows another modified example of the embodiment, and is a circuit diagram showing a structure of an important part of a pixel.
Figure 15:
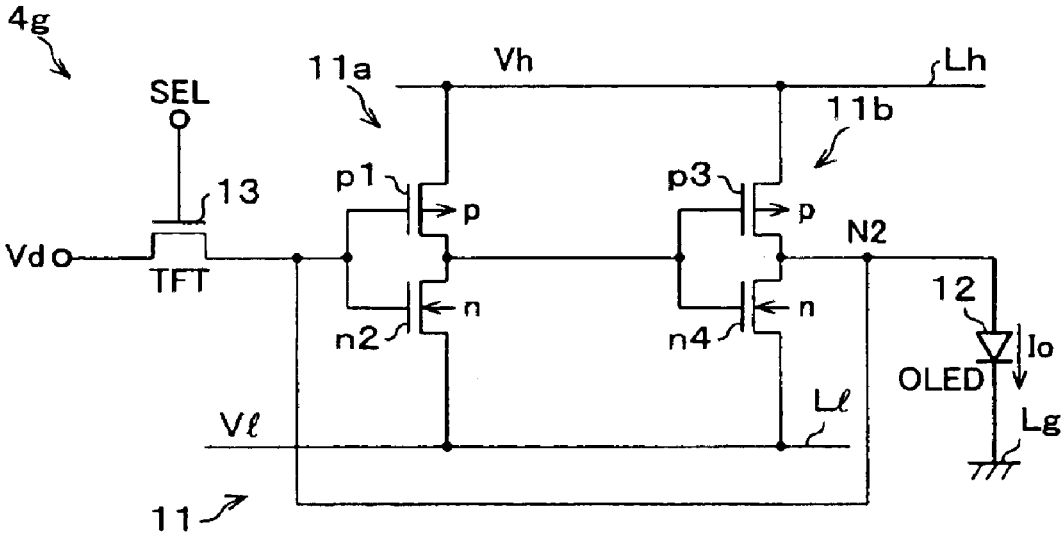
FIG. 15 shows still another modified example of the embodiment, and is a circuit diagram showing a structure of an important part of a pixel.

Further, like the pixels 4*f* to 4*g* shown in FIG. 13 to FIG. 15, a potential different from both the power voltages Vh and Vl may be applied to one end of the OLED 12 (end different from the output end of the memory circuit 11) while the memory circuit 11 is driven by the positive and negative power voltages Vh and Vl. Note that, FIG. 13 shows a structure which is different from that of the pixel 4 shown in FIG. 1 in that the cathode electrode of the OLED 12 is separated from the power electrode of the memory circuit 11, and the cathode electrode of the OLED 12 is grounded. Further, the pixel 4*f* shown in FIG. 14 corresponds to the pixel 4*a* shown in FIG. 9, and the reference potential Vref is applied to the anode electrode of the OLED 12. Further, the pixel 4*g* shown in FIG. 15 corresponds to the pixel 4*b* shown in FIG. 10, and the cathode of the OLED 12 is grounded.

According to the structures, in addition to the effects brought about by the pixels 4 to 4*d*, the electrode of the OLED 12 is separated from the electrode of the memory circuit 11, so that it is possible to manufacture the electrodes respectively by different manufacturing methods, and to apply voltages different from each other for a reason such as improvement of the characteristics. Further, the respective electrodes are separated from each other, so that it is possible to provide the electrode of the OLED 12 on an upper layer or a lower layer of the OLED 12, that is, on a layer different from a layer on which the electrode of the memory circuit 11 is provided. Thus, compared with a case where the electrodes are provided on the same surface, the aperture ratio can be improved. Note that, it is still preferable that at least one electrode of both the electrodes of the OLED 12 is a transparent electrode, because it is possible to perform luminous display through the transparent electrode.

Incidentally, in the display element 1 shown in FIG. 2, each pixel 4(i,j) has one OLED 12, and lights or unlights each OLED 12 in accordance with a value (binary) stored in the memory circuit 11. On the other hand, in a display element 1*h* shown in FIG. 16, each pixel 4*h* is divided into plural sub pixels 41 and 42, and the gradation display is performed in accordance with combination of light/light-off of the sub pixels 41 and 42. The sub pixel 41 (42) has the same structure as any one of the respective pixels 4 to 4*g*, and the luminance level of the respective sub pixels 41 and 42 is set to be a luminance level, at which the luminance of the pixel 4*h* has a desired gradation in accordance with a combination of light/light-off of the respective sub pixels 41 and 42, for example, by adjusting an luminous area of the OLED 12 or a level of supplied power.

Figure 16:
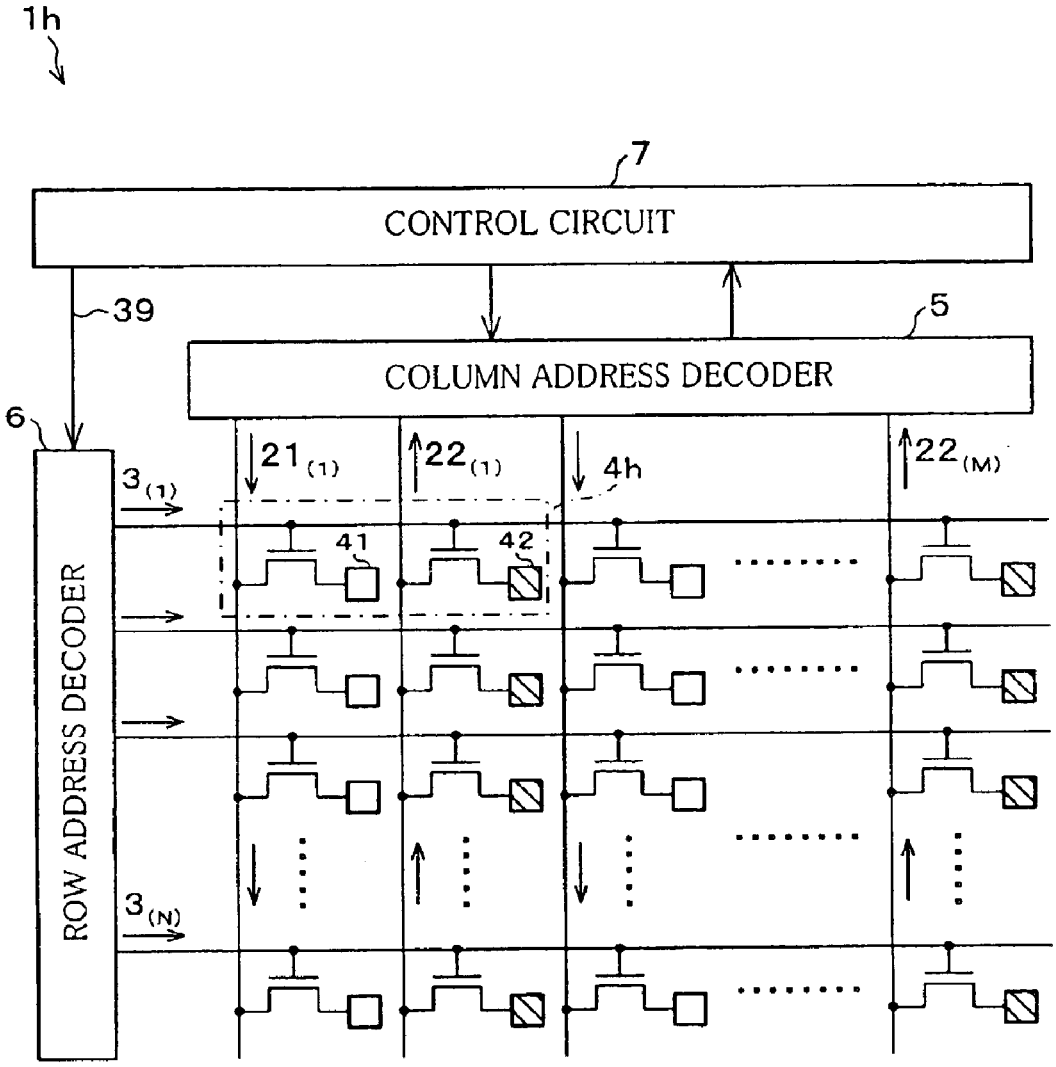
FIG. 16 shows another modified example of the embodiment, and is a circuit diagram showing a structure of an important part of a display element.

Note that, FIG. 16, as an example, shows a case where one pixel 4*h*(i,j) is arranged in accordance with combination of two sub pixels 41(i,j) and 42(i,j) adjacent in a direction of a column (a direction along a select line 3(i)), and the pixel 4*h*(i,j) is driven by a data line 21(j), which supplies the data potential Vd to the sub pixel 41(i,j), and a data line 22(j), which supplies the data potential Vd to the sub pixel 42(i,j). Reasonably, it is possible to set the number of sub pixels for dividing the pixel 4*h* to be a desired value according to the required gradient. Further, as long as the respective sub pixels are provided adjacent to each other so as to be seen as one pixel, they may be provided along the select line 3, or along the data line 2 (21, 22). When the respective pixels are provided along the select line 3 and are connected to the same select line 3, it is possible to access the respective memory circuits 11 of all the sub pixels only by selecting the corresponding select line 3, so that the access time can be reduced. Note that, this example shows a case where data is written in the memory circuit 11 of the sub pixel 41 and data is read from the memory circuit 11 of the sub pixel 42.

Figure 17:
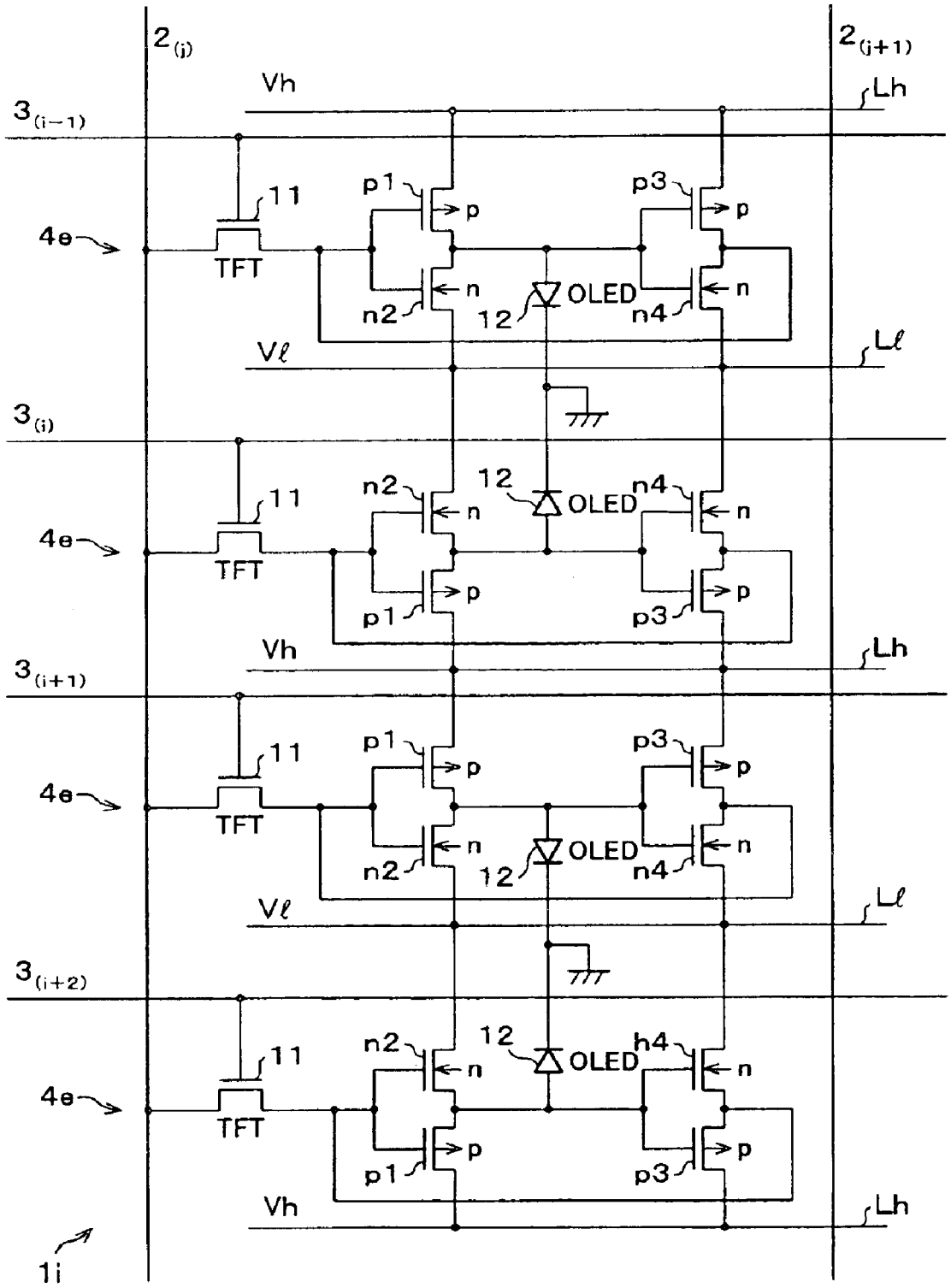
FIG. 17 shows still another modified example of the embodiment, and is a circuit diagram showing a structure of an important part of adjacent pixels.
Figure 18:
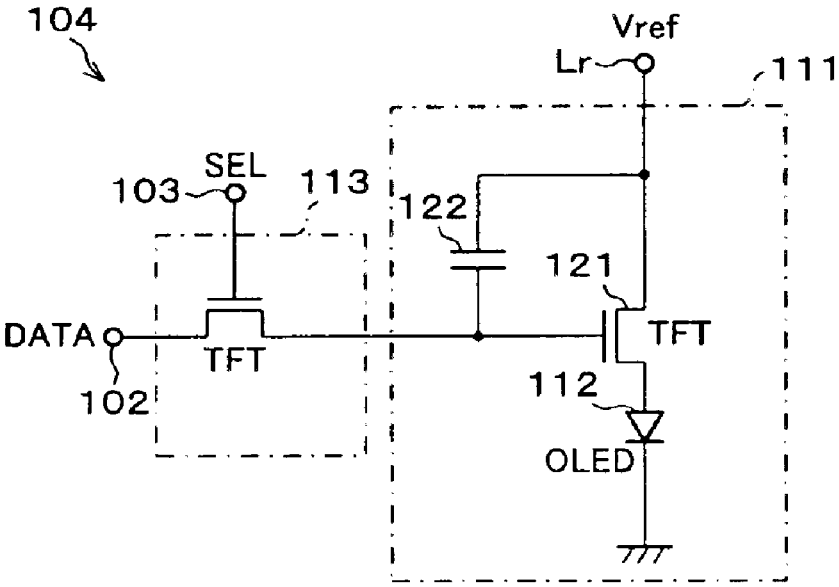
FIG. 18 PRIOR ART
FIG. 18 shows a prior art, and is a circuit diagram showing a structure of an important part of a pixel.
Figure 19:
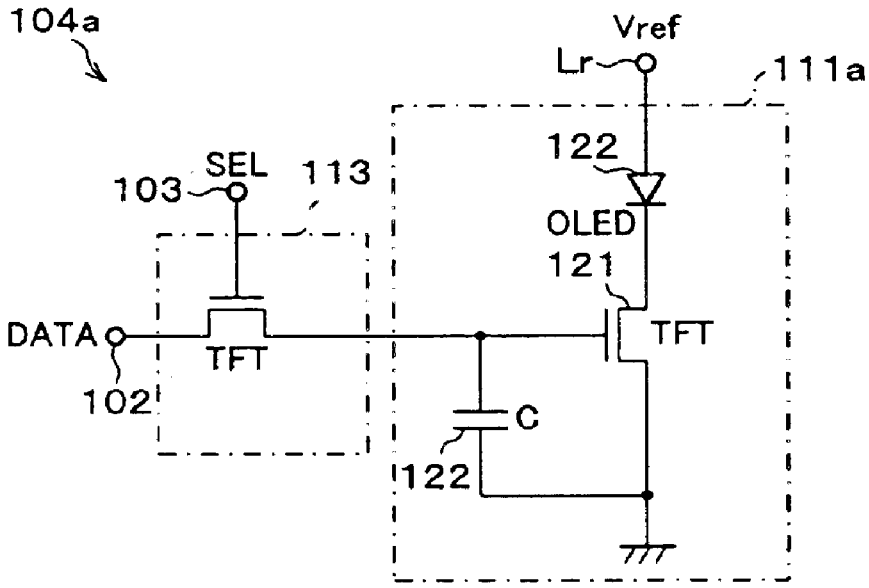
FIG. 19 PRIOR ART
FIG. 19 shows prior art, and is a circuit diagram showing a structure of an important part of a pixel.

Here, in examples of FIG. 2 and FIG. 16, the case, where the respective pixels 4 (4*h*) are formed in the same direction, is described for the sake of convenience. However, like the present embodiment, in the case where each of the pixels 4 to 4*h* includes the memory circuit 11, and not only the data line 2 and the select line 3 but also the power lines, which supply the reference potential Vref and the ground level or the power voltages Vh and Vl, is connected to the respective pixels 4 to 4*h*, it is preferable that the respective pixels 4 to 4*h* or the respective sub pixels 41 and 42 are provided so that they are axially symmetrical, like the display element 1*i* shown in FIG. 17. Note that, FIG. 17 shows a case where the pixels 4*e* shown in FIG. 13 are provided so that they are axially symmetrical with respect to the select line 3, as an example. Further, the power line Lh, which supplies the power voltage Vh, and the power line Ll, which supplies the power potential Vl, are alternately provided along the select line 3.

According to the arrangement, since the pixels 4*e* are provided so that they are axially symmetrical with respect to the select lines 3 as the reference line, elements (TFTp1, TFTp3), connected to the corresponding power line Lh, are provided closer to each other compared with the case where they are provided in the same direction in the pixels 4*e* and 4*e*, and the power line Lh can be shared between the pixels 4*e* and 4*e*. In the same way, the power line Ll can be shared between the pixels 4*e* and 4*e* adjacent to the select line 3 along the power line Ll. As a result, even in a case where the number of pixels (the number of the data lines 2 and the number of the select lines 3) are equalized, it is possible to reduce the number of the power lines, required in forming a display element 1*i*, to substantially 1/2, and to improve the aperture ratio. Note that, in the foregoing description, the case of providing the pixels so that they are axially symmetrical with respect to the select line 3 is described, but when the pixels are provided so that they are axially symmetrical with respect to the data line 2, it is also possible to obtain the same effect since the power line (ground line) can be shared between the pixels provided so that the data line 2 exists therebetween.

As described above, a memory-integrated element (1 and 1*h* to 1*i*) according to the present invention includes: an optical modulation element (OLED 12) provided in a pixel (4 and 4*a* to 4*i*); and a memory element (11), provided in the pixel, which stores binary data which indicates a value inputted to the optical modulation element, wherein the memory element is arranged by connecting at least two inverters (11*a* and 11*b*) in a loop manner, and an output of the output inverter (11*a* or 11*b*), one of the respective inverters, which functions as an output end of the memory element, is directly connected to one end of the optical modulation element. Note that, the output end of the memory element and the optical modulation element are directly connected to each other, for example, by connecting the output end of the memory element to an anode of the optical modulation element, or by connecting the output end of the memory element to a cathode of the optical modulation element. Here, it is possible to select a pole (anode or cathode of the optical modulation element), to which the output end is to be connected, according to an optical characteristic of material of the optical modulation element, and according to the matching with respect to the quality of material of which a substrate is made.

According to the foregoing structure, the output end of the memory element and the optical modulation element are directly connected to each other, so that it is possible to reduce the number of switching elements since a drive switching element is not required, compared with a prior art in which the memory element and the optical modulation element are connected to each other via the drive switching element. Note that, since the output inverter, which functions as the output end, drives the optical modulation element, the optical modulation element can be driven without any problem, even when the drive switching element is omitted.

Further, since the drive switching element does not exist between the memory element and the optical modulation element, it is possible to obtain the following advantage. In a case where an optical modulation element whose luminance varies quickly with respect to an applied voltage is used, for example, in a case where a current drive type LED (Light Emission Diode) is used as the optical modulation element, even though the dispersion occurs in manufacturing, variation of the luminance level of the optical modulation element, which is brought about by variation of a characteristic of the drive switching element, does not occur. Thus, the optical modulation element can be lighted at a constant luminance level.

Particularly, in a case where pixels, made up of the optical modulation elements and the memory elements, are provided in a matrix manner, the variation of the luminance level is seen as the dispersion brought about in the display state in which the respective pixels should display uniformly, and this deteriorates the display quality. However, according to the foregoing structure, the dispersion of the luminance level does not occur, so that it is possible to prevent the deterioration of the display quality.

Further, in addition to the foregoing structure, it is preferable that the memory-integrated display element according to the present invention includes electric charge emitting circuit (the TFTp1 or the TFTn2 or the TFTp3 or the TFTn4) for emitting electric charge, stored in the optical modulation element while the memory element is applying a voltage to the optical modulation element, after application of the voltage is finished.

According to the structure, after the memory element finishes applying a voltage, the electric charge emitting circuit emits the electric charge, stored in the optical modulation element, so that the optical modulation element can shift to the next display state more quickly, compared with a case where the electric charge emitting circuit is not provided. Further, even in a case where the left electric charge is likely to vary the display state of the optical modulation element and to deteriorate the display quality of the memory-integrated display element, for example, even in a case where the current drive type optical modulation element is used, it is possible to prevent occurrence of the display error. Further, even in a case where, like the OLED (Organic Light Emission Diode), an optical modulation element, which is likely to burn and deteriorate due to the left electric charge, is used, the electric charge emitting circuit emits the electric charge, so that it is possible to restrict the burning and the deterioration of the optical modulation element.

Further, in the memory-integrated display element according to the present invention, the output inverter may be a complementary inverter such as a CMOS (Complementary MOS).

According to the structure, even in a case where the memory element stores either of binary such as light/light-off, either of the switching elements (for example, combination of the p type transistor and the n type transistor), which make up the complementary inverter, is conducted. Thus, even though the electric charge is stored in the optical modulation element in a certain display state, the left electric charge is emitted quickly via the conducted switching element, and the optical modulation element can shift to the next display state quickly. Thus, as in the case where the electric charge emitting circuit is provided, it is possible to prevent the occurrence of the display error, or the burning and the deterioration of the optical modulation element.

Further, in addition to the foregoing structure, the memory-integrated display element according to the present invention may be arranged as follows. The complementary inverter includes: a p type transistor (TFTp1 or TFTp3) connected to the first power line (Lh or Lr); and an n type transistor (TFTn2 or TFTn4) connected to the second power line (Lg or Ll), and an anode of the optical modulation element is connected to an output end of the output inverter, and a cathode of the optical modulation element is connected to the second power line, and when a ratio of an OFF resistance value of the n type transistor with respect to an ON resistance value of the p type transistor is K, a ratio of an ON resistance value of the p type transistor with respect to an ON resistance value of the optical modulation element is set to be substantially $(K+1)^{1/2}/K$.

Further, in addition to the structure in which the complementary inverter is provided as the output inverter, the memory-integrated display element according to the present invention may be arranged as follows. The complementary inverter includes: a p type transistor (TFTp1 or TFTp3) connected to the first power line (Lh or Lr); and an n type transistor (TFTn2 or TFTn4) connected to the second power line (Lg or Ll), and an anode of the optical modulation element is connected to an output end of the output inverter, and a cathode of the optical modulation element is connected to the second power line, and when a ratio of an OFF resistance value of the n type transistor with respect to an ON resistance value of the p type transistor is K, and a dispersion quantity of lighting luminance of the optical modulation element is within ±x % with respect to a reference value, a ratio of an ON resistance value of the p type transistor with respect to an ON resistance value of the optical modulation element is set to be a range from $(K+1)^{1/2}\cdot(1-x/100)/K$ to $(K+1)^{1/2}\cdot(1+x/100)/K$.

According to the foregoing connection, in the case where the respective resistance values are set as described above, when the p type transistor and the optical modulation element are conducted and the n type transistor is shut off, the power consumption of the output inverter and the optical modulation element are substantially minimized. While, in a case where the optical modulation element is shut off, the resistance value becomes sufficiently large, compared with a conducting state of the optical modulation element. Further, since the p type transistor is shut off and the n type transistor is conducted, a voltage applied to the optical modulation element is substantially 0, so that the power consumption of the output inverter and the optical modulation element is small, compared with the conducting state of the optical modulation element. Thus, it is possible to reduce the power consumption of the memory-integrated display element by setting the respective resistance values as described above.

While, in the structure in which the output inverter is the complementary inverter, the memory-integrated display element according to the present invention may be arranged as follows. The complementary inverter includes: a p type transistor (TFTp1 or TFTp3) connected to the first power line (Lh or Lr); and an n type transistor (TFTn2 or TFTn4) connected to the second power line (Lg or Ll), and a cathode of the optical modulation element is connected to an output end of the output inverter, and an anode of the optical modulation element is connected to the first power line, and when a ratio of an OFF resistance value of the p type transistor with respect to an ON resistance value of the n type transistor is K, a ratio of an ON resistance value of the n type transistor with respect to an ON resistance value of the optical modulation element is set to be substantially $(K+1)^{1/2}/K$.

Further, in the structure in which the output inverter is the complementary inverter, the memory-integrated display element according to the present invention may be arranged as follows. The complementary inverter includes: a p type transistor (TFTp1 or TFTp3) connected to the first power line (Lh or Lr); and an n type transistor (TFTn2 or TFTn4) connected to the second power line (Lg or Ll), and a cathode of the optical modulation element is connected to an output end of the output inverter, and an anode of the optical modulation element is connected to the first power line, and when a ratio of an OFF resistance value of the p type transistor with respect to an ON resistance value of the n type transistor is K, and a dispersion quantity of lighting luminance of the optical modulation element is within ±x % with respect to a reference value, a ratio of an ON resistance value of the n type transistor with respect to an ON resistance value of the optical modulation element is set to be the range from $(K+1)^{1/2}\cdot(1-x/100)/K$ to $(K+1)^{1/2}\cdot(1+x/100)/K$.

According to the foregoing connection, in the case where the respective resistance values are set as described above, when the n type transistor and the optical modulation element are conducted and the p type transistor is shut off, the power consumption of the output inverter and the optical modulation element is substantially minimized. Further, as in the case where the cathode is connected to the second power line, the power consumption is sufficiently small, when the optical modulation element is shut off. Thus, it is possible to reduce the power consumption of the memory-integrated display element by setting the respective resistance values as described above.

Further, in the foregoing structure, the memory-integrated display element according to the present invention may be arranged as follows. One pixel unit is arranged by a plurality of sub pixels (41 and 42), each of which includes the optical modulation element and the memory element. According to the structure, one pixel unit is made up of the plural sub pixels, and the luminance level of one pixel unit can bear gradation in accordance with combination of optical modulation states (binary) of the respective sub pixels. As a result, even though the memory element can store only the binary such as light/light-off, it is possible to set the gradation expression number of the pixel to be more than 2. Further, even in a case where the gradation expression is performed by time-sharing drive, it is possible to reduce time-sharing drive number relatively by combination of the time-sharing drive and the pixel-dividing drive, so that it is possible to set the drive frequency of the memory-integrated display element.

Further, in accordance with the foregoing structure, in the memory-integrated display element according to the present invention, one of the power electrodes of the memory element may be used also as the anode or the cathode of the optical modulation element. Thus, compared with a case where electrodes are provided individually, the total area of the electrodes can be reduced, so that it is possible to improve the aperture ratio of the memory-integrated display element.

While, in the memory-integrated display element according to the present invention, instead of sharing an electrode, the first and second electrodes of the memory element, and the anode and the cathode of the optical modulation element may be provided separately. According to the structure, it is possible to apply voltages to the respective electrodes individually, in a case where improvement of a characteristic is required.

Note that, regardless of whether an electrode is shared or not, a level of a voltage, applied to the respective power electrodes of the memory element, may be identical to an output level of the memory element. Or, for example, in a case where there is a predetermined difference of potential between both the levels, both the levels do not have to be identical to each other. In a case where they are not identical to each other, the levels of voltages, applied to the respective power electrodes, are adjusted so that the memory element outputs the voltage levels which cause the optical modulation element to display appropriately.

Further, in addition to the foregoing structure, it is preferable that the memory-integrated display element according to the present invention is arranged as follows. The memory-integrated display element includes: a plurality of data signal lines (2 . . . ); and a plurality of select signal lines (3 . . . ) which cross the respective data signal lines at right angle, and the memory element is provided in each of combinations of the data signal lines and the select signal lines, and stores binary data indicated by a data signal line corresponding to the memory element, in a case where a select signal line corresponding to the memory element instructs the memory element to select, and the memory element is provided adjacent to another memory element, via a reference line, either of the data signal line and the select signal line, so that both memory elements are axially symmetrical with respect to the reference line, and the optical modulation element is provided adjacent to another optical modulation element, via the reference line, so that both optical modulation elements are axially symmetrical with respect to the reference line, and a power line is shared by the both memory elements, or the both optical modulation elements.

According to the structure, the memory element is provided adjacent to another memory element, via a reference line, either of the data signal line and the select signal line, so that both memory elements are axially symmetrical with respect to the reference line, and the optical modulation element is provided adjacent to another optical modulation element, via the reference line, so that both optical modulation elements are axially symmetrical with respect to the reference line, and a power line is shared by the both memory elements, or the both optical modulation elements. As a result, the number of the power lines, required in the memory-integrated display element, is reduced. Thus, the number of the electrodes, required in the memory-integrated display element, can be reduced, so that it is possible to realize a memory-integrated display element whose aperture ratio is high.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A memory-integrated display element, comprising:

an optical modulation element provided in a pixel;

a memory element, provided in the pixel, which stores binary data, which indicates a value inputted to the optical modulation element, wherein:

said memory element is arranged by connecting at least an input inverter and an output inverter to each other in a loop manner, wherein an output of the input inverter is input into the output inverter, and wherein said output inverter is a complementary inverter, and an output of the output inverter which functions as an output end of the memory element, is directly connected to one end of the optical modulation element, wherein said complementary inverter includes: a p type transistor connected to a first power line; and an n type transistor connected to a second power line, and an anode of the optical modulation element is connected to an output end of the output inverter, and a cathode of the optical modulation element is connected to the second power line, and when a ratio of an OFF resistance value of the n type transistor with respect to an ON resistance value of the p type transistor is K, a ratio of an ON resistance value of the p type transistor with respect to an ON resistance value of the optical modulation element is set to be substantially $(K+1)^{1/2}/K$.

2. The memory-integrated display element set forth in claim 1, wherein said optical modulation element is a current drive type optical modulation element whose luminous intensity varies in accordance with a current quantity.

3. The memory-integrated display element set forth in claim 1, wherein said optical modulation element is an Organic Light Emission Diode.

4. The memory-integrated display element set forth in claim 1, further comprising electric charge emitting means for emitting electric charge, which has been stored in the optical modulation element while the memory element was applying a voltage to the optical modulation element, after the memory element finishes applying the voltage.

5. The memory-integrated display element set forth in claim 1, wherein said optical modulation element and said memory element are included in each of plural sub pixels which make up one pixel unit.

6. A memory-integrated display element, comprising:

an optical modulation element provided in a pixel;

a memory element, provided in the pixel, which stores binary data, which indicates a value inputted to the optical modulation element, wherein:

said memory element is arranged by connecting at least an input inverter and an output inverter to each other in a loop manner, wherein an output of the input inverter is input into the output inverter, and wherein said output inverter is a complementary inverter, and an output of the output inverter which functions as an output end of the memory element, is directly connected to one end of the optical modulation element, wherein said complementary inverter includes: a p type transistor connected to a first power line; and an n type transistor connected to a second power line, and an anode of the optical modulation element is connected to an output end of the output inverter, and a cathode of the optical modulation element is connected to the second power line, and when a ratio of an OFF resistance value of the n type transistor with respect to an ON resistance value of the p type transistor is K, and a dispersion quantity of lighting luminance of the optical modulation element is within ±x % with respect to a reference value, a ratio of an ON resistance value of the p type transistor with respect to an ON resistance value of the optical modulation element is set to be a range from $(K+1)^{1/2}\cdot(1-x/100)/K$ to $(K+1)^{1/2}\cdot(1+x/100)/K$.

7. The memory-integrated display element set forth in claim 6, wherein said optical modulation element is a current drive type optical modulation element whose luminous intensity varies in accordance with a current quantity.

8. The memory-integrated display element set forth in claim 6, wherein said optical modulation element is an Organic Light Emission Diode.

9. The memory-integrated display element set forth in claim 6, further comprising electric charge emitting means for emitting electric charge, which has been stored in the optical modulation element while the memory element was applying a voltage to the optical modulation element, after the memory element finishes applying the voltage.

10. The memory-integrated display element set forth in claim 6, wherein said optical modulation element and said memory element are included in each of plural sub pixels which make up one pixel unit.

11. A memory-integrated display element, comprising:

an optical modulation element provided in a pixel;

a memory element, provided in the pixel, which stores binary data, which indicates a value inputted to the optical modulation element, wherein:

said memory element is arranged by connecting at least an input inverter and an output inverter to each other in a loop manner, wherein an output of the input inverter is input into the output inverter, and wherein said output inverter is a complementary inverter, and an output of the output inverter which functions as an output end of the memory element, is directly connected to one end of the optical modulation element, wherein said complementary inverter includes: a p type transistor connected to a first power line; and an n type transistor connected to a second power line, and a cathode of the optical modulation element is connected to an output end of the output inverter, and an anode of the optical modulation element is connected to the first power line.

12. The memory-integrated display element set forth in claim 11, further comprising electric charge emitting means for emitting electric charge, which has been stored in the optical modulation element while the memory element was applying a voltage to the optical modulation element, after the memory element finishes applying the voltage.

13. The memory-integrated display element set forth in claim 11, wherein said optical modulation element and said memory element are included in each of plural sub pixels which make up one pixel unit.

14. The memory-integrated display element set forth in claim 11, wherein said optical modulation element is a current drive type optical modulation element whose luminous intensity varies in accordance with a current quantity.

15. The memory-integrated display element set forth in claim 11, wherein said optical modulation element is an Organic Light Emission Diode.

16. A memory-integrated display element, comprising:

an optical modulation element provided in a pixel;

a memory element, provided in the pixel, which stores binary data, which indicates a value inputted to the optical modulation element, wherein:

said memory element is arranged by connecting at least an input inverter and an output inverter to each other in a loop manner, wherein an output of the input inverter is input into the output inverter, and wherein said output inverter is a complementary inverter, and an output of the output inverter which functions as an output end of the memory element, is directly connected to one end of the optical modulation element, wherein said complementary inverter includes: a p type transistor connected to a first power line; and an n type transistor connected to a second power line, and a cathode of the optical modulation element is connected to an output end of the output inverter, and an anode of the optical modulation element is connected to the first power line, and when a ratio of an OFF resistance value of the p type transistor with respect to an ON resistance value of the n type transistor is K, a ratio of an ON resistance value of the n type transistor with respect to an ON resistance value of the optical modulation element is set to be substantially $(K+1)^{1/2}/K$.

17. The memory-integrated display element set forth in claim 12, further comprising electric charge emitting means for emitting electric charge, which has been stored in the optical modulation element while the memory element was applying a voltage to the optical modulation element, after the memory element finishes applying the voltage.

18. The memory-integrated display element set forth in claim 16, wherein said optical modulation element and said memory element are included in each of plural sub pixels which make up one pixel unit.

19. A memory-integrated display element, comprising:

an optical modulation element provided in a pixel;

a memory element, provided in the pixel, which stores binary data, which indicates a value inputted to the optical modulation element, wherein:

said memory element is arranged by connecting at least an input inverter and an output inverter to each other in a loop manner, wherein an output of the input inverter is input into the output inverter, and wherein said output inverter is a complementary inverter, and an output of the output inverter which functions as an output end of the memory element, is directly connected to one end of the optical modulation element, wherein said complementary inverter includes: a p type transistor connected to a first power line; and an n type transistor connected to a second power line, and a cathode of the optical modulation element is connected to an output end of the output inverter, and an anode of the optical modulation element is connected to the first power line, and when a ratio of an OFF resistance value of the p type transistor with respect to an ON resistance value of the n type transistor is K, and—a dispersion quantity of lighting luminance of the optical modulation element is within ±x % with respect to a reference value, a ratio of an ON resistance value of the n type transistor with respect to an ON resistance value of the optical modulation element is set to be a range from $(K+1)^{1/2}\cdot(1-x/100)/K$ to $(K+1)^{1/2}\cdot(1+x/100)/K$.

20. The memory-integrated display element set forth in claim 19, wherein said optical modulation element is a current drive type optical modulation element whose luminous intensity varies in accordance with a current quantity.

21. The memory-integrated display element set forth in claim 19, wherein said optical modulation element is an Organic Light Emission Diode.

22. The memory-integrated display element set forth in claim 19, further comprising electric charge emitting means for emitting electric charge, which has been stored in the optical modulation element while the memory element was applying a voltage to the optical modulation element, after the memory element finishes applying the voltage.

23. The memory-integrated display element set forth in claim 19, wherein said optical modulation element and said memory element are included in each of plural sub pixels which make up one pixel unit.

24. A memory-integrated display element, comprising:

an optical modulation element provided in a pixel;

a memory element, provided in the pixel, which stores binary data, which indicates a value inputted to the optical modulation element, wherein:

said memory element is arranged by connecting at least an input inverter and an output inverter to each other in a loop manner, wherein an output of the input inverter is input into the output inverter, and wherein said output inverter is a complementary inverter, and an output of the output inverter which functions as an output end of the memory element, is directly connected to one end of the optical modulation element, wherein said memory element includes a power electrode which is used also as either of an anode or a cathode of the optical modulation element.

25. The memory-integrated display element set forth in claim 24, further comprising electric charge emitting means for emitting electric charge, which has been stored in the optical modulation element while the memory element was applying a voltage to the optical modulation element, after the memory element finishes applying the voltage.

26. The memory-integrated display element set forth in claim 24, wherein said optical modulation element and said memory element are included in each of plural sub pixels which make up one pixel unit.

27. The memory-integrated display element set forth in claim 24, wherein said optical modulation element is a current drive type optical modulation element whose luminous intensity varies in accordance with a current quantity.

28. The memory-integrated display element set forth in claim 24, wherein said optical modulation element is an Organic Light Emission Diode.

29. A memory-integrated display element, comprising:

an optical modulation element provided in a pixel;

a memory element, provided in the pixel, which stores binary data, which indicates a value inputted to the optical modulation element, wherein:

said memory element is arranged by connecting at least an input inverter and an output inverter to each other in a loop manner, wherein an output of the input inverter is input into the output inverter, and wherein said output inverter is a complementary inverter, and an output of the output inverter which functions as an output end of the memory element, is directly connected to one end of the optical modulation element, wherein said memory element includes a first power electrode and a second power electrode, and said optical modulation element includes an anode and a cathode, and the first power electrode and the second power electrode are provided separately from the anode and the cathode.

30. The memory-integrated display element set forth in claim 29, further comprising electric charge emitting means for emitting electric charge, which has been stored in the optical modulation element while the memory element was applying a voltage to the optical modulation element, after the memory element finishes applying the voltage.

31. The memory-integrated display element set forth in claim 29, wherein said optical modulation element and said memory element are included in each of plural sub pixels which make up one pixel unit.

32. The memory-integrated display element set forth in claim 29, wherein said optical modulation element is a current drive type optical modulation element whose luminous intensity varies in accordance with a current quantity.

33. The memory-integrated display element set forth in claim 29, wherein said optical modulation element is an Organic Light Emission Diode.

34. A memory-integrated display element, comprising:

an optical modulation element provided in a pixel;

a memory element, provided in the pixel, which stores binary data, which indicates a value inputted to the optical modulation element, wherein:

said memory element is arranged by connecting at least an input inverter and an output inverter to each other in a loop manner, wherein an output of the input inverter is input into the output inverter, and wherein said output inverter is a complementary inverter, and an output of the output inverter which functions as an output end of the memory element, is directly connected to one end of the optical modulation element, further comprising:

a plurality of data signal lines; and a plurality of select signal lines which cross the data signal lines at right angle, wherein:

said memory element is provided in each of combinations of the data signal lines and the select signal lines, and stores binary data indicated by a data signal line corresponding to the memory element, in a case where a select signal line corresponding to the memory element instructs the memory element to select, and the memory element is provided adjacent to another memory element, via a reference line, either of the data signal line and the select signal line, so that both memory elements are axially symmetrical with respect to the reference line, and the optical modulation element is provided adjacent to another optical modulation element, via the reference line, so that both optical modulation elements are axially symmetrical with respect to the reference line, and a power line is shared by the both memory elements, or the both optical modulation elements.

35. The memory-integrated display element set forth in claim 34, further comprising electric charge emitting means for emitting electric charge, which has been stored in the optical modulation element while the memory element was applying a voltage to the optical modulation element, after the memory element finishes applying the voltage.

36. The memory-integrated display element set forth in claim 34, wherein said optical modulation element and said memory element are included in each of plural sub pixels which make up one pixel unit.

37. The memory-integrated display element set forth in claim 34, wherein said optical modulation element is a current drive type optical modulation element whose luminous intensity varies in accordance with a current quantity.

38. The memory-integrated display element set forth in claim 34, wherein said optical modulation element is an Organic Light Emission Diode.

* * * * *